US010241439B2

(12) United States Patent
Wakimoto et al.

(10) Patent No.: US 10,241,439 B2
(45) Date of Patent: Mar. 26, 2019

(54) IMAGE FORMING APPARATUS WITH DETACHABLE TONER CONTAINER

(71) Applicant: KYOCERA Document Solutions Inc., Osaka-shi, Osaka (JP)

(72) Inventors: Atsuhiro Wakimoto, Osaka (JP); Hiroki Morishita, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 15/877,193

(22) Filed: Jan. 22, 2018

(65) Prior Publication Data

US 2018/0210370 A1 Jul. 26, 2018

(30) Foreign Application Priority Data

Jan. 25, 2017 (JP) ..... 2017-011040

(51) Int. Cl.
*G03G 15/08* (2006.01)
*G03G 15/00* (2006.01)
*G03G 21/16* (2006.01)

(52) U.S. Cl.
CPC ..... *G03G 15/0855* (2013.01); *G03G 15/0865* (2013.01); *G03G 15/502* (2013.01); *G03G 15/556* (2013.01); *G03G 21/1633* (2013.01); *G03G 2215/0678* (2013.01); *G03G 2221/169* (2013.01)

(58) Field of Classification Search
CPC ..... G03G 15/0855; G03G 15/556; G03G 15/502; G03G 15/0865; G03G 21/1633; G03G 2215/0678; G03G 2221/169
See application file for complete search history.

(56) References Cited

U.S. PATENT DOCUMENTS 5,430,531 A * 7/1995 Kamiya ..... G03G 15/0856 222/DIG. 1
2007/0230999 A1* 10/2007 Shimomura ..... G03G 21/1652 399/113
2010/0272452 A1 10/2010 Tsukijima
2011/0058825 A1* 3/2011 Tsukijima ..... G03G 21/1633 399/27

FOREIGN PATENT DOCUMENTS

JP 2010256557 A 11/2010

* cited by examiner

*Primary Examiner* — Erika J Villaluna
(74) *Attorney, Agent, or Firm* — Alleman Hall Creasman & Tuttle LLP

(57) ABSTRACT

A lever member is displaceably provided to a toner container. A container locking mechanism locks the toner container at a mounting position in a container mounting portion when the lever member is operated from a first operation position to a second operation position in a state where the toner container is located at the mounting position. A locking member is displaceable between a lever locking position and a lever releasing position. A locking control portion controls a drive portion to displace the locking member to the lever locking position when a remaining amount of the toner detected by the remaining amount detection portion is equal to or greater than a predetermined amount, and controls the drive portion to displace the locking member to the lever releasing position when the remaining amount of the toner detected by the remaining amount detection portion is less than the predetermined amount.

9 Claims, 24 Drawing Sheets

IMAGE FORMING APPARATUS WITH DETACHABLE TONER CONTAINER

INCORPORATION BY REFERENCE

This application is based upon and claims the benefit of priority from the corresponding Japanese Patent Application No. 2017-011040 filed on Jan. 25, 2017, the entire contents of which are incorporated herein by reference.

BACKGROUND

The present disclosure relates to an image forming apparatus in which a toner container is detachably mounted at a mounting position.

An image forming apparatus that forms an image on a print sheet by electrophotography, such as a copying machine and a printer, is equipped with a developing device. Toner within the developing device is decreased by development being performed by the developing device. Thus, the image forming apparatus is configured such that the toner container containing the toner is mountable to and detachable from the image forming apparatus. The toner container is provided with: a toner discharge port for discharging the toner; and an opening/closing member for opening/closing the toner discharge port. In a state where the toner container is mounted, the opening/closing member is displaced from a closing position to an opening position. Accordingly, the toner discharge port is opened, and the toner within the toner container is supplied to the developing device. When the toner within the toner container is discharged to be emptied, the empty toner container is replaced with a new toner container filled with toner.

Hitherto, an image forming apparatus is known in which a plurality of doors corresponding to respective toner containers are provided at an outlet for taking out a toner container at the time of replacement. In the image forming apparatus, the doors are locked in a normal state, and when the remaining amount of the toner within the toner container becomes small and a predetermined input signal is inputted, the door corresponding to the input signal is made openable.

SUMMARY

An image forming apparatus according to one aspect of the present disclosure includes a toner container, a container mounting portion, a lever member, a container locking mechanism, a locking member, a drive portion, a remaining amount detection portion, and a locking control portion. The toner container has a toner discharge port through which toner within a container body is discharged. The container mounting portion is configured to detachably mount the toner container. The lever member is displaceably provided to the toner container. The container locking mechanism is configured to lock the toner container at a mounting position in the container mounting portion when the lever member is operated from a first operation position to a second operation position in a state where the toner container is located at the mounting position. The locking member is configured to be displaceable between a lever locking position at which the locking member is engaged with the lever member to lock the lever member at the second operation position and a lever releasing position at which the locking member is retracted from the lever locking position to unlock the lever member locked at the second operation position. The drive portion is configured to provide driving force to the locking member. The remaining amount detection portion is configured to detect a remaining amount of the toner within the container body. The locking control portion is configured to control the drive portion to displace the locking member to the lever locking position when the remaining amount of the toner detected by the remaining amount detection portion is equal to or greater than a predetermined amount, and to control the drive portion to displace the locking member to the lever releasing position when the remaining amount of the toner detected by the remaining amount detection portion is less than the predetermined amount.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1A:
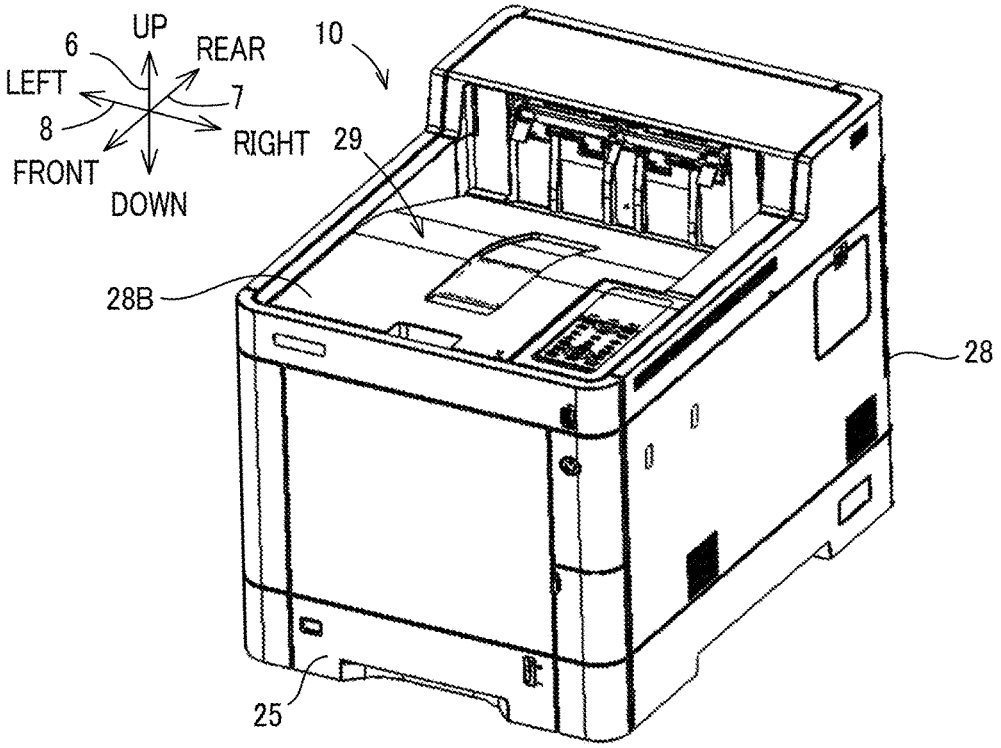
FIGS. 1A and 1B are perspective views showing the configuration of an image forming apparatus according to an embodiment of the present disclosure.

Hereinafter, an embodiment of the present disclosure will be described with reference to the accompanying drawings. The following embodiment is an example embodying the present disclosure and does not limit the technical scope of the present disclosure. For convenience of explanation, in an installation state where an image forming apparatus 10 is usable (the state shown in FIG. 1A), the vertical direction is defined as an up-down direction 6. In addition, a front-rear direction 7 is defined with, as a front face (front surface), a surface through which a sheet feed device 25 is inserted/pulled out in the installation state. Moreover, a right-left direction 8 is defined on the basis of the front face of the image forming apparatus 10 in the installation state.

[Image Forming Apparatus 10]

The image forming apparatus 10 according to the embodiment of the present disclosure is an apparatus having at least a print function. The image forming apparatus 10 is a so-called tandem-type color printer. As a matter of course, the image forming apparatus 10 may not be an apparatus that forms a color image, but may be an apparatus that forms a single-color image.

Figure 1B:
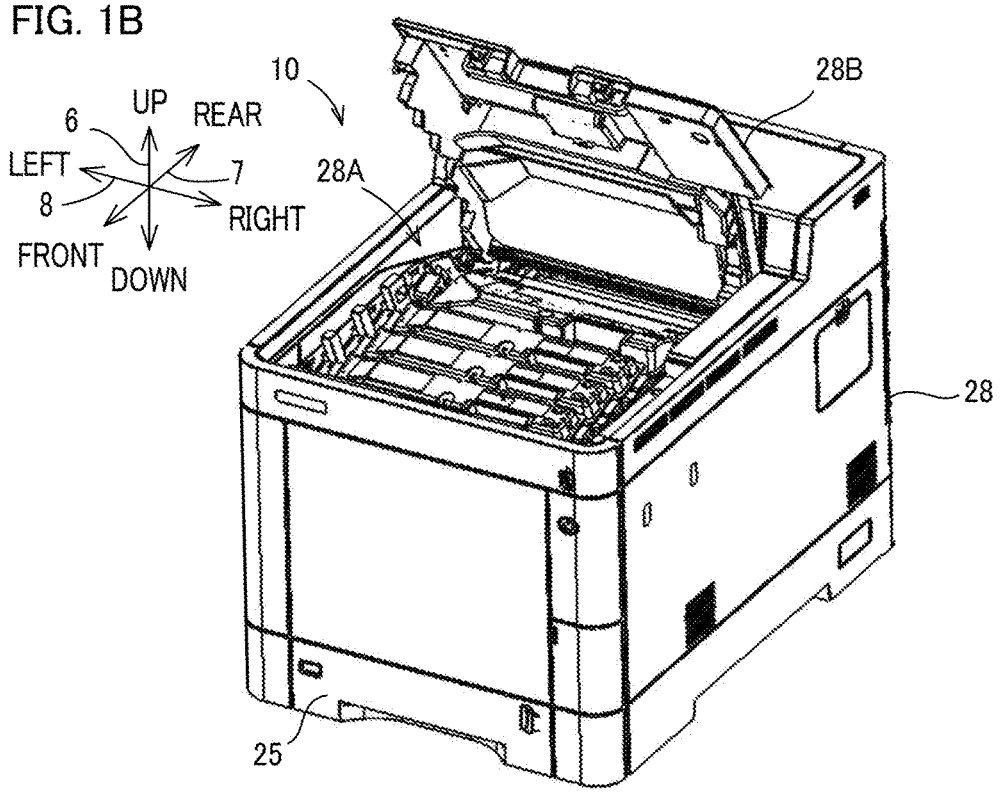
Figure 2:
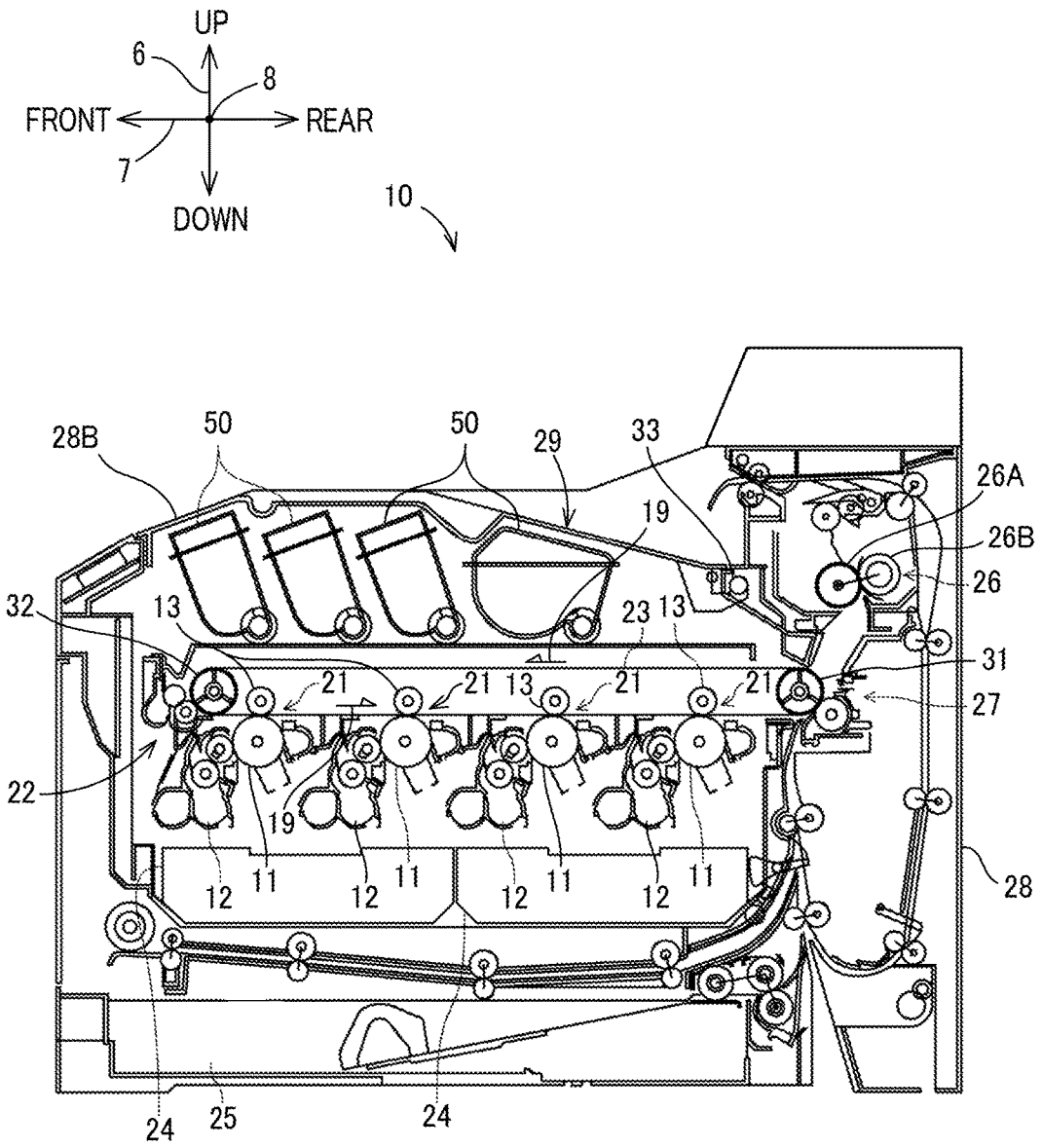
FIG. 2 is a cross-sectional view showing the internal configuration of the image forming apparatus.

As shown in FIGS. 1A, 1B, and 2, the image forming apparatus 10 includes an apparatus body 28. The apparatus body 28 is a housing that includes an outer frame, an inner frame of the image forming apparatus 10, and an exterior panel, etc. Each component forming the image forming apparatus 10 is provided within the apparatus body 28. As shown in FIG. 1B, an opening 28A is formed in the upper surface of the apparatus body 28. In addition, as shown in FIG. 1A, the apparatus body 28 is provided with a top cover 28B that is able to open/close the opening 28A.

Figure 5:
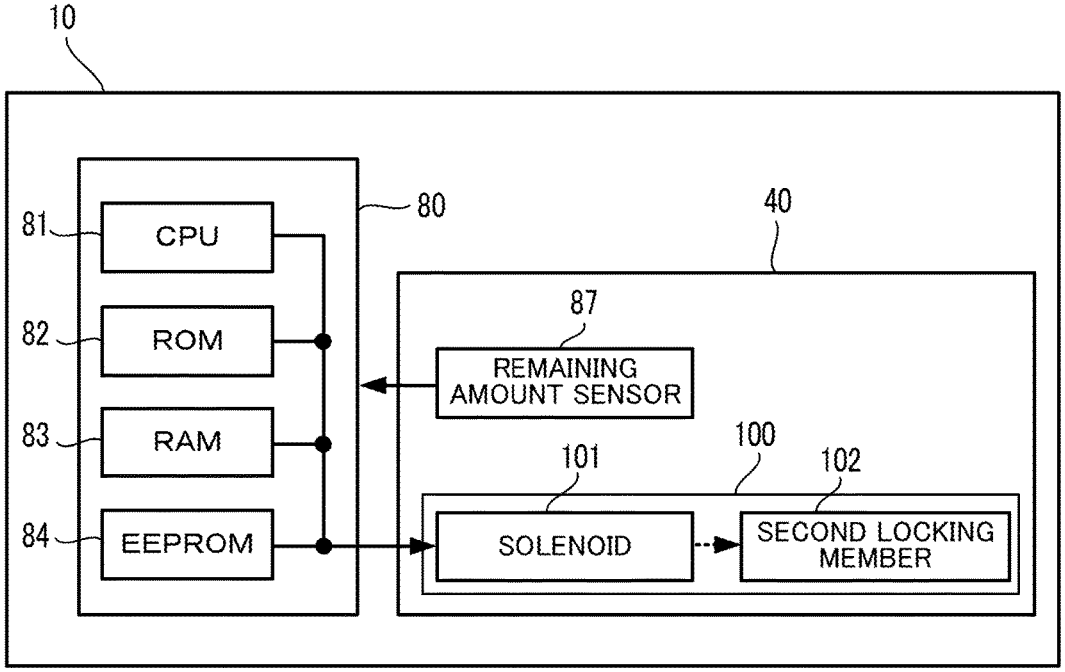
FIG. 5 is a block diagram showing the configuration of a control portion of the image forming apparatus.

As shown in FIG. 2, the image forming apparatus 10 mainly includes four image forming portions 21, an intermediate transfer unit 22, the sheet feed device 25, a fixing device 26, a secondary transfer device 27, two exposure devices 24, four toner containers 50 (50A to 50D), a mounting portion 40 (see FIG. 3, an example of a container mounting portion), and a control portion 80 (an example of a locking control portion, see FIG. 5). These components are provided within the apparatus body 28 of the image forming apparatus 10. The toner containers 50 are an example of a toner container in the image forming apparatus 10.

The four image forming portions 21 are disposed within the apparatus body 28 and below the intermediate transfer unit 22. The respective image forming portions 21 are aligned along the front-rear direction 7. The respective image forming portions 21 form toner images on photosensitive drums 11 and sequentially transfer the toner images onto a transfer belt 23 of the intermediate transfer unit 22 in an overlaid manner. The transfer belt 23 moves in the direction of an arrow 19, and the toner images are sequentially transferred onto the transfer belt 23 during the movement. In the example shown in FIG. 2, the image forming portions 21 corresponding to black, cyan, magenta, and yellow, respectively, are arranged within the apparatus body 28 in a line in order from the downstream side (the right side in FIG. 2) of the movement direction of the transfer belt 23 (the arrow 19 direction).

Each image forming portion 21 performs an image forming process of forming an image on a print sheet on the basis of so-called electrophotography. Each image forming portion 21 includes the photosensitive drum 11, a charging device, a developing device 12, and a primary transfer device 13, etc. The developing device 12 develops a toner image on the photosensitive drum 11. Specifically, the developing device 12 applies toner to an electrostatic latent image on the photosensitive drum 11 and develops the electrostatic latent image with the toner to form a toner image as a visible image on the surface of the photosensitive drum 11.

The intermediate transfer unit 22 is disposed above the image forming portions 21. A drive pulley 31 and a driven pulley 32 are provided at both ends, in the front-rear direction 7, of the intermediate transfer unit 22. The transfer belt 23 is supported so as to extend between and on the drive pulley 31 and the driven pulley 32. Accordingly, the transfer belt 23 extends in the front-rear direction 7 in a state where a belt surface thereof is horizontal. In addition, since the transfer belt 23 is supported by the drive pulley 31 and the driven pulley 32, the transfer belt 23 is rotatable in the direction of the arrow 19. The transfer belt 23 is an endless annular belt formed from a material such as rubber or urethane.

Since the transfer belt 23 is supported by the drive pulley 31 and the driven pulley 32, the transfer belt 23 can move (run) while the surface thereof is in contact with the surface of each photosensitive drum 11. When the surface of the transfer belt 23 passes between each photosensitive drum 11 and each primary transfer device 13, a toner image is sequentially transferred from each photosensitive drum 11 in an overlaid manner onto the surface of the transfer belt 23. Accordingly, a color toner image is formed on the surface of the transfer belt 23.

The secondary transfer device 27 transfers, onto a print sheet conveyed from a paper feed tray of the sheet feed device 25, the toner image that has been transferred onto the transfer belt 23 and includes a plurality of colors. Accordingly, the color toner image is formed on the print sheet. The print sheet having the toner image transferred thereon is conveyed to the fixing device 26. The fixing device 26 fixes the toner image transferred onto the print paper, to the print paper by heat. A sheet discharge tray 29 is formed on the upper surface of the top cover 28B of the apparatus body 28.

After the fixing by the fixing device 26, the print sheet is discharged to the sheet discharge tray 29.

The four toner containers 50 (50A to 50D) are mounted to the mounting portion 40. The four toner containers 50 are disposed above the intermediate transfer unit 22. The four toner containers 50 are provided within the apparatus body 28 so as to be arranged along the transfer belt 23 and in a line along the front-rear direction 7. Each toner container 50 is configured to supply toner to the developing device 12 for the corresponding color.

The top cover 28B is provided at an upper portion of the apparatus body 28. The top cover 28B covers the opening 28A in the upper portion of the apparatus body 28. The top cover 28B is supported so as to be rotatable about a support shaft 33 (see FIG. 2) that is provided to the apparatus body 28. Accordingly, the top cover 28B is rotatable between a position at which the top cover 28B covers and closes the opening 28A and a position at which the top cover 28B is separated from the opening 28A to open the opening 28A. The support shaft 33 is provided rearward of the four toner containers 50. When the top cover 28B is rotated upward (in the opening direction), the mounting portion 40 is exposed.

Figure 3A:
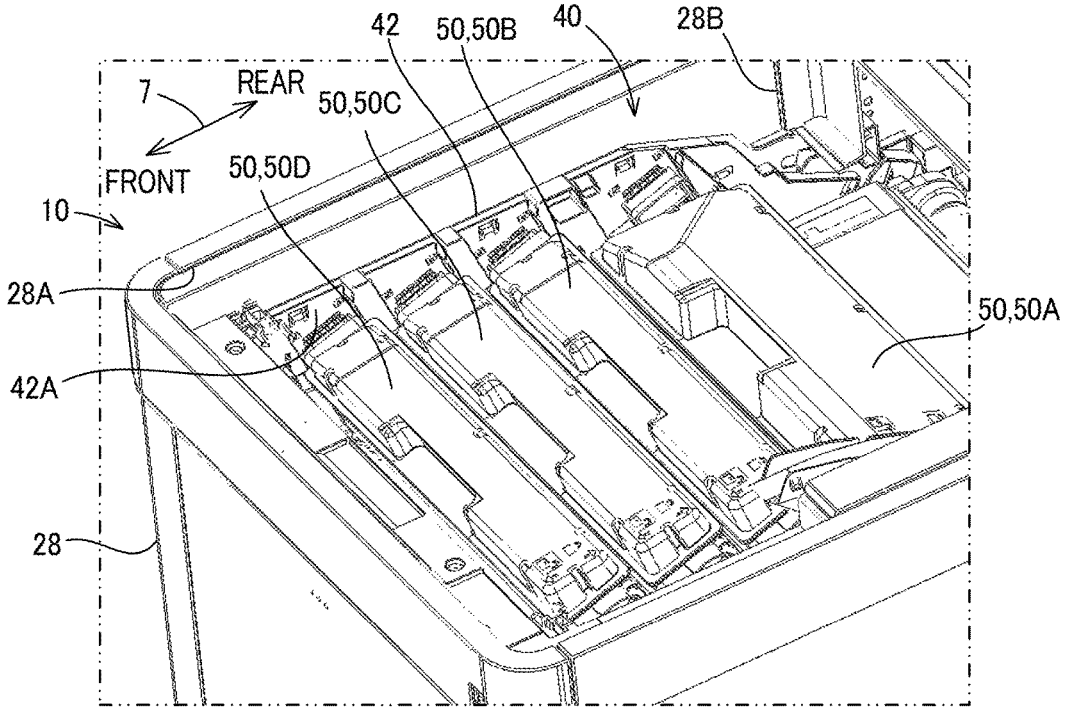
FIG. 3A is a diagram showing a mounted state where toner containers are mounted to the image forming apparatus.
Figure 3B:
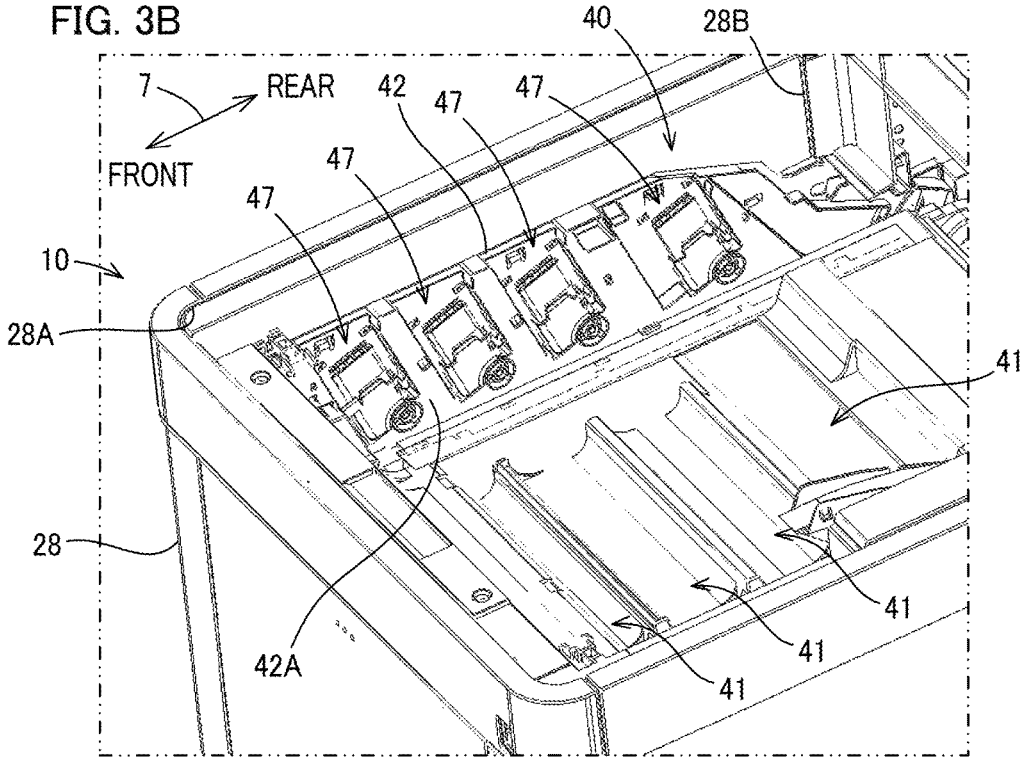
FIG. 3B is a diagram showing a mounting portion for the toner containers in the image forming apparatus.
Figure 4:
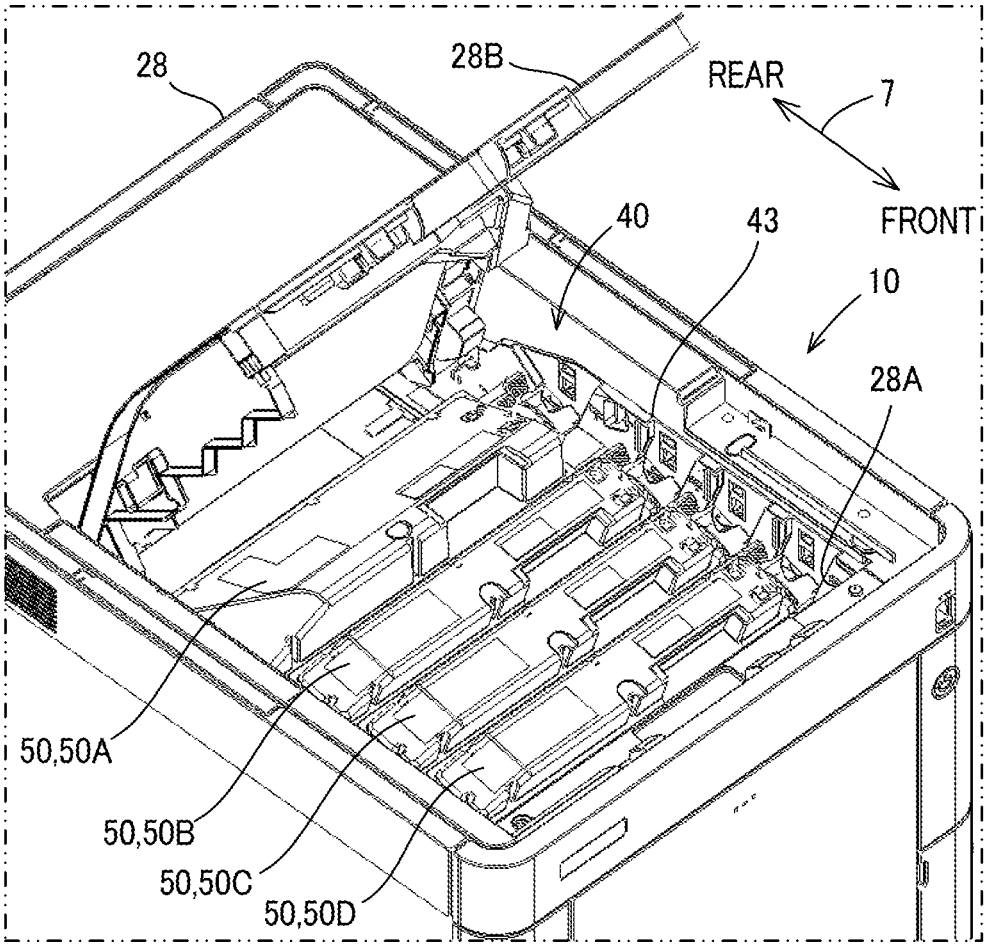
FIG. 4 is a diagram showing a mounted state where the toner containers are mounted to the image forming apparatus.

The mounting portion 40 detachably mounts each toner container 50. As shown in FIGS. 3A, 3B, and 4, the mounting portion 40 is provided within the apparatus body 28. Specifically, the mounting portion 40 is provided between the top cover 28B and the intermediate transfer unit 22. In the present embodiment, the mounting portion 40 is formed so as to be integrated with an upper portion of the intermediate transfer unit 22. Each toner container 50 is inserted into the mounting portion 40 through the opening 28A and mounted to the mounting portion 40 by a user in a state where the top cover 28B is opened. Four housing spaces 41 are formed in the mounting portion 40, and each toner container 50 is mounted to the mounting portion 40 in a state where the toner container 50 is housed in the housing space 41. The mounting portion 40 is not limited to a portion formed so as to be integrated with the upper portion of the intermediate transfer unit 22, and may be provided in the apparatus body 28 as a member separate from the intermediate transfer unit 22.

The respective toner containers 50 contain toner of colors corresponding to the respective colors of the image forming portions 21. Specifically, the toner containers 50 (50A to 50D) contain black toner, cyan toner, magenta toner, and yellow toner, respectively. As shown in FIGS. 2, 3A, and 3B, among the four toner containers 50, the toner container 50A located at the rearmost side is of a type having a larger capacity than the other toner containers 50B to 50D. The toner container 50A contains black toner. In addition, the toner containers 50B to 50D have the same shape and the same capacity. The toner container 50B contains cyan toner, the toner container 50C contains magenta toner, and the toner container 50D contains yellow toner.

The control portion 80 centrally controls the image forming apparatus 10. As shown in FIG. 5, the control portion 80 includes a CPU 81, a ROM 82, a RAM 83, and an EEPROM (registered trademark) 84, etc. The ROM 82 is a non-volatile storage unit, the RAM 83 is a volatile storage unit, and the EEPROM 84 is a non-volatile storage unit. The RAM 83 and the EEPROM 84 are used as temporary storage memories for various processes to be executed by the CPU 81. In addition, a predetermined control program is stored in the ROM 82. The control portion 80 may be composed of an electronic circuit such as an integrated circuit (ASIC, DSP).

The mounting portion 40 is provided with: a remaining amount sensor 87 (an example of a remaining amount detection portion, see FIG. 5) for detecting the remaining amount of the toner within the mounted toner container 50; and a solenoid 101 (an example of a drive portion) for providing driving force to a later-described second locking member 102 (an example of a locking member, see FIG. 17). The remaining amount sensor 87 is provided for each of the four toner containers 50, and four remaining amount sensors 87 are provided in total. Each remaining amount sensor 87 is, for example, a weight sensor for measuring the weight of the mounted toner container 50. Each remaining amount sensor 87 sends a detection signal indicating a measured value, to the control portion 80. The control portion 80 determines the remaining amount of the toner within the toner container 50 on the basis of the detection signal sent from the remaining amount sensor 87. In addition, the control portion 80 determines whether the determined remaining amount of the toner has decreased to a predetermined amount. Specifically, the control portion 80 determines whether the remaining amount of the toner is an amount in which the toner is evaluated as being emptied (empty) (hereinafter, referred to as "empty state"). The weight sensor is exemplified as the remaining amount sensor 87, but, for example, a sensor for detecting a remaining amount on the basis of a change in magnetic permeability, or the like may be used.

The solenoid 101 is a so-called pull-type solenoid including a plunger 101A (see FIG. 17) that is retracted into a solenoid body when the solenoid is energized and that is made free when the solenoid is de-energized. In the present embodiment, the solenoid 101 is provided for each of the four toner containers 50, and four solenoids 101 are provided in total. The solenoids 101 are mounted on a later-described support plate 43.

[Toner Containers 50]

Hereinafter, the configuration of each toner container 50 will be described. Here, the large-capacity type toner container 50A and the other toner containers 50B to 50D have the same configuration except that the sizes of toner containing portions thereof are different from each other. In addition, the toner containers 50B to 50D have the same configuration except that the positions at which the toner containers 50B to 50D are disposed are different from each other. Therefore, in the following, the toner containers 50A to 50D are described as toner containers 50.

Each toner container 50 contains toner to be supplied to the developing device 12. The toner container 50 is supported by the mounting portion 40 so as to be detachable from the mounting portion 40 (see FIG. 3A). The toner container 50 is inserted through the opening 28A in the upper surface of the apparatus body 28 into the apparatus body 28 and mounted in each housing space 41 of the mounting portion 40.

Figure 6:
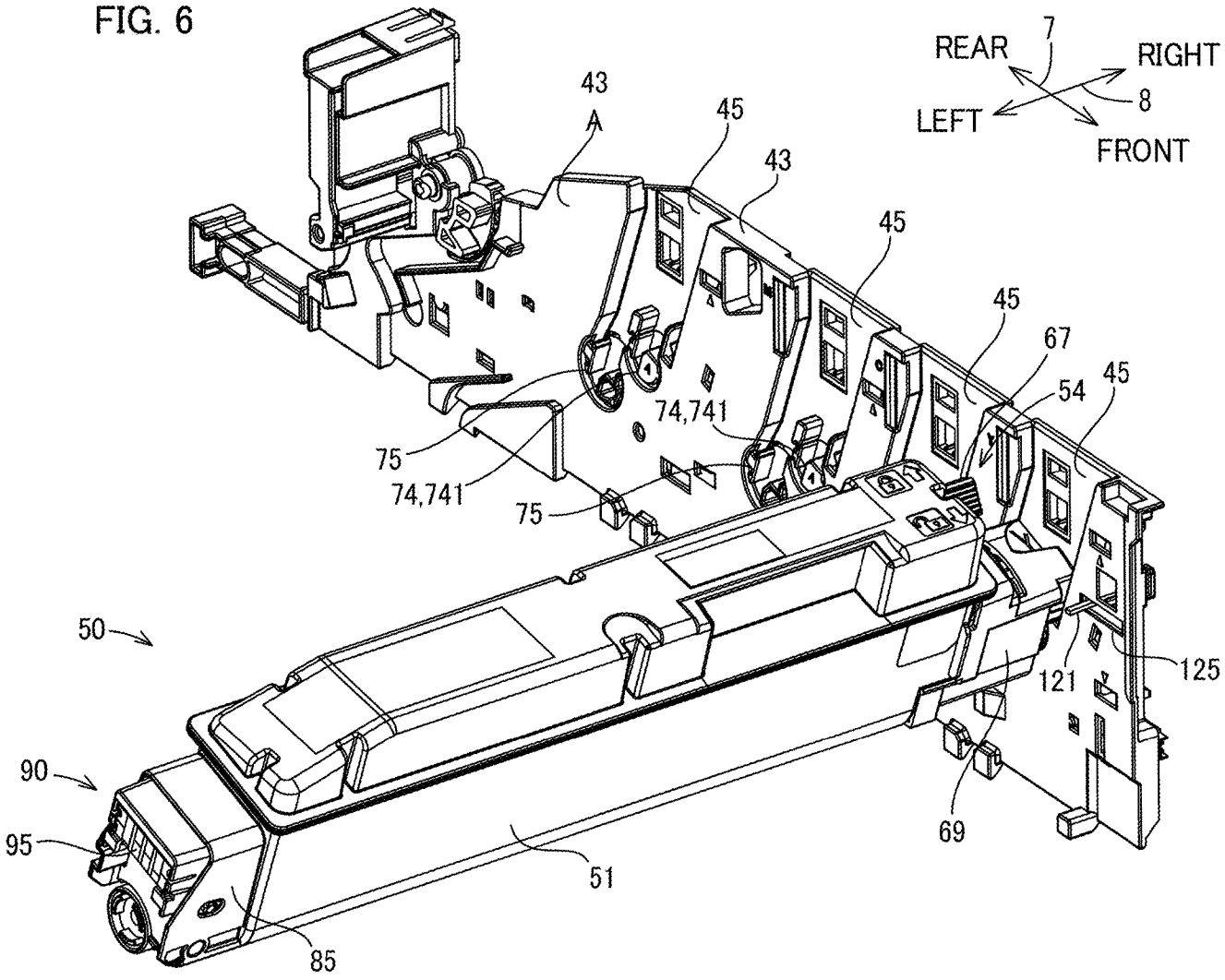
FIG. 6 is a diagram showing the toner container and a support plate of the mounting portion.
Figure 7:
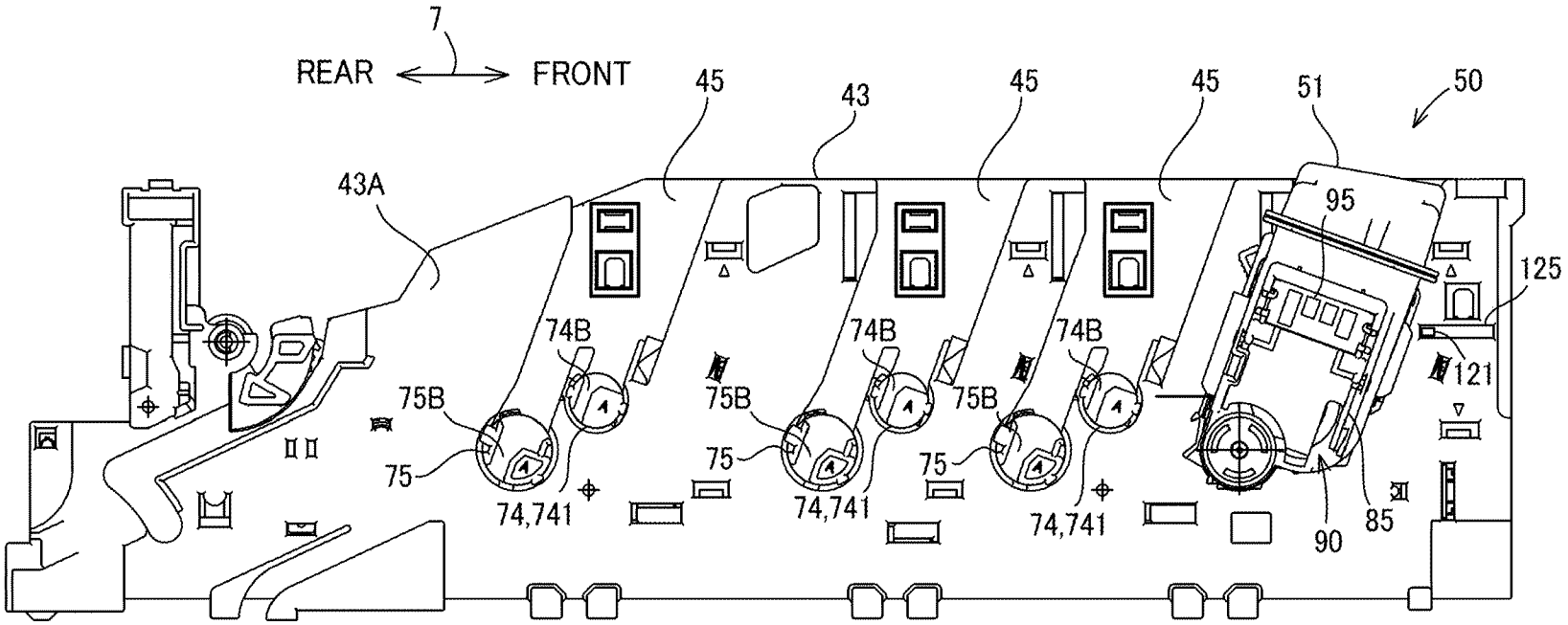
FIG. 7 is a diagram showing the toner container and the support plate of the mounting portion.
Figure 8:
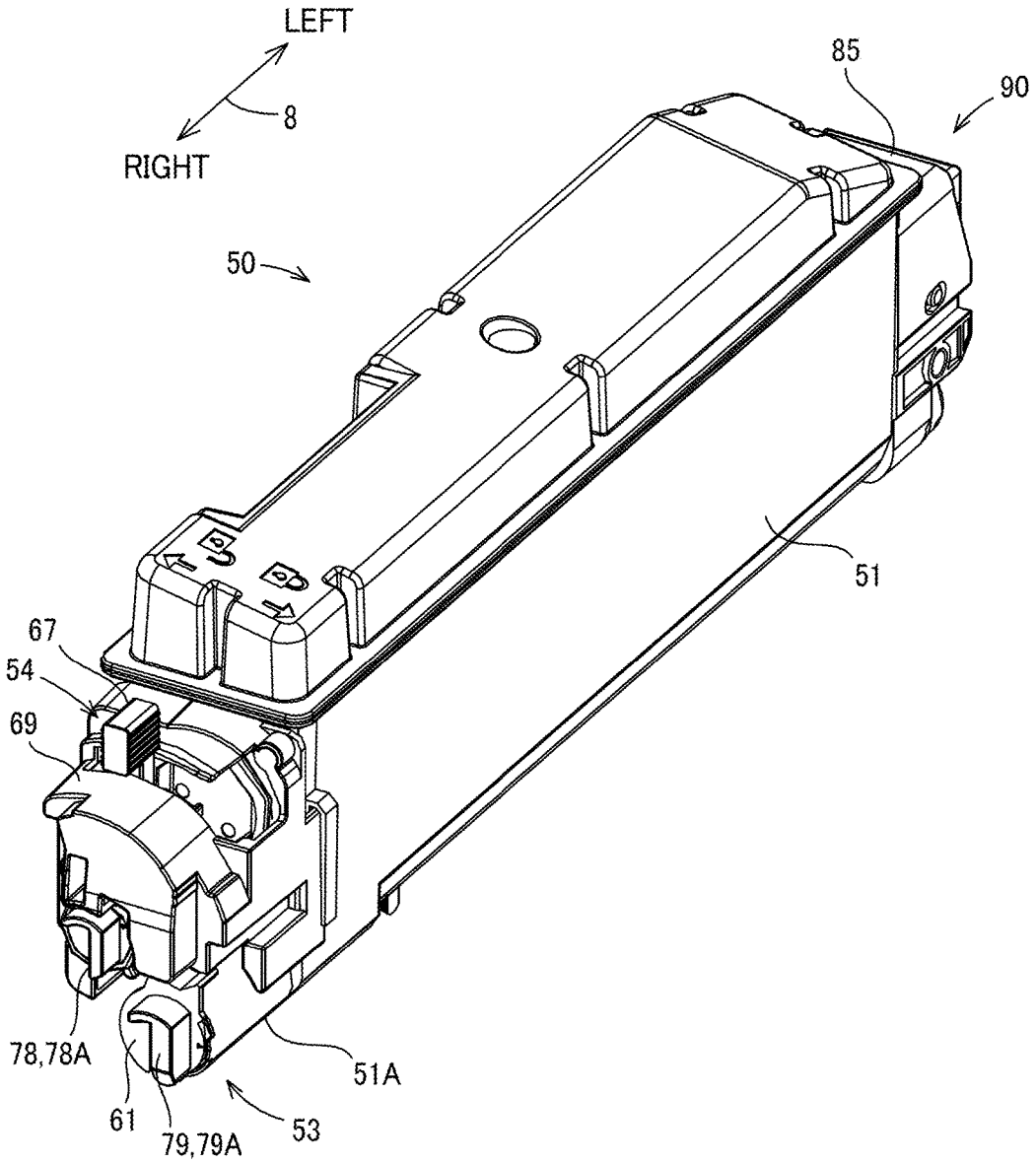
FIG. 8 is a perspective view showing the toner container.
Figure 9:
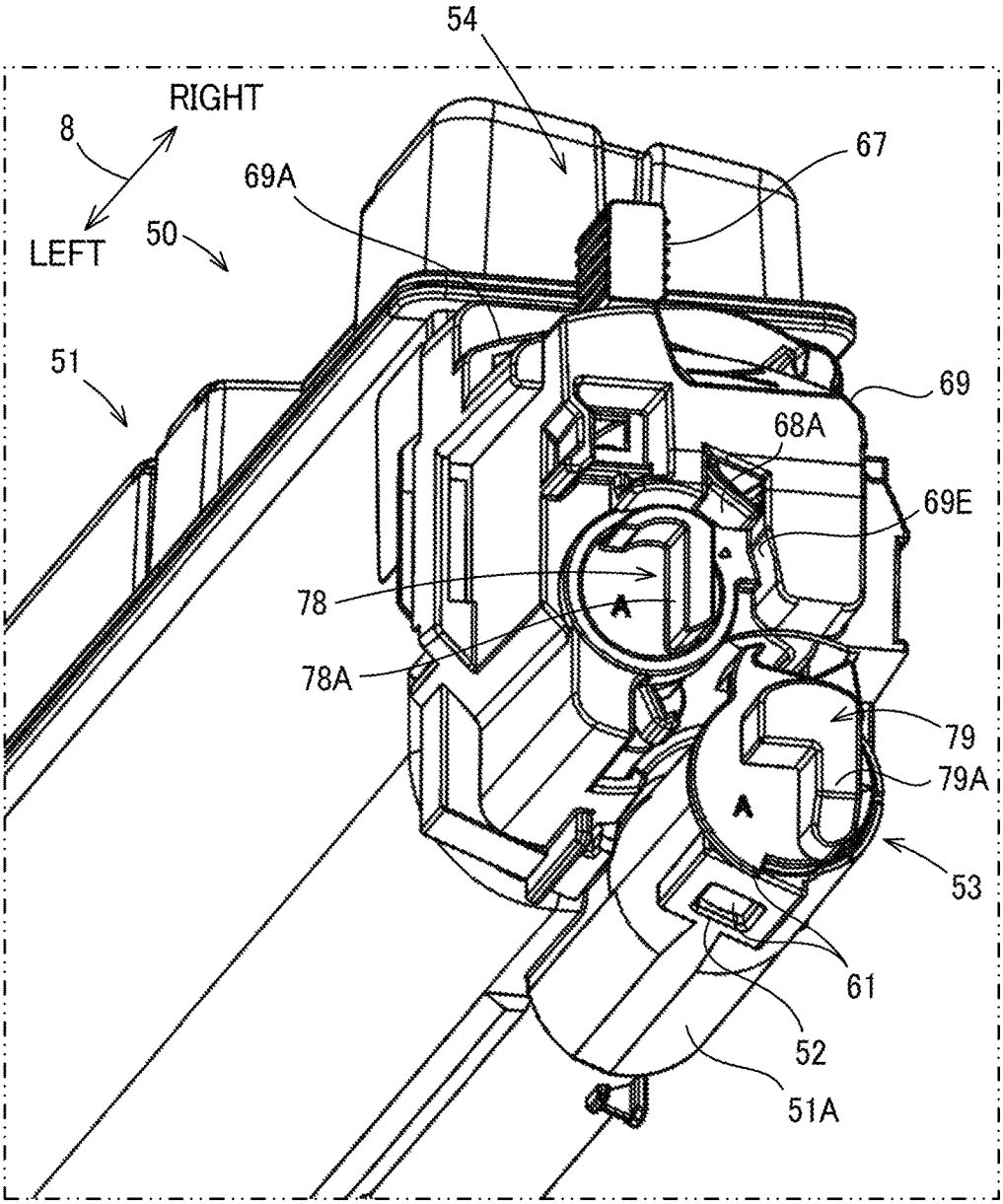
FIG. 9 is a perspective view showing the configuration of a right side end portion of the toner container.

As shown in FIGS. 6 to 9, the toner container 50 includes a housing 51 (an example of a container body) in which the toner is stored, a toner discharge port 52 (see FIG. 9), an opening/closing mechanism 53 (see FIG. 9), an operation portion 54, a cover 69 as a cover portion, and a memory holder 90. The housing 51 is mounted to the mounting portion 40 of the image forming apparatus 10. The toner is stored in a storage chamber 57 (see FIG. 10A) that is defined within the housing 51. That is, the internal space of the housing 51 is the storage chamber 57 for the toner. As shown in FIG. 9, the toner discharge port 52 is formed in the housing 51. The toner discharge port 52 is formed in a right end portion of the bottom surface of the housing 51. In addition, as shown in FIGS. 8 and 9, the operation portion 54 is provided to the housing 51 so as to be able to be operated by the user.

The housing 51 is made of a resin material and formed in a box shape that is long in the right-left direction 8. That is, the longitudinal direction of the housing 51 coincides with the right-left direction 8 of the image forming apparatus 10 shown in FIG. 1A.

An agitation paddle (not shown) for agitating the toner and a conveyance screw 58 (see FIG. 10A) as a conveying member are provided in the storage chamber 57, which is the interior of the housing 51. The conveyance screw 58 receives driving force to be rotated, thereby conveying the toner to the toner discharge port 52.

As shown in FIGS. 3A, 3B, and 4, the mounting portion 40 includes a pair of support plates 42 and 43 to which the toner container 50 is mounted. The support plate 43 is not shown in FIG. 3, and the support plate 42 is not shown in FIG. 4. Each of the support plates 42 and 43 are formed in a plate shape and extends in the front-rear direction 7. The support plates 42 and 43 are disposed in the mounting portion 40 so as to be spaced apart from each other in the right-left direction 8 and oppose to each other. As shown in FIG. 3A, the support plate 42 is erected at a left end portion of the mounting portion 40. As shown in FIG. 4, the support plate 43 is erected at a right end portion of the mounting portion 40. The mounting portion 40 supports both ends, in the longitudinal direction, of each of the four toner containers 50 by the support plates 42 and 43.

As shown in FIG. 6, the memory holder 90 is mounted on a side wall, at one side in the longitudinal direction, of the housing 51. Specifically, a projection 85 is formed so as to be integrated with the side wall, and the memory holder 90 is mounted on the projection 85. A contact terminal 95 is provided on the surface of the memory holder 90 and electrically connected to a memory that is provided within the memory holder 90 and that is not shown.

As shown in FIGS. 3A and 3B, four attachment portions 47 are provided on a right side surface 42A at one side (the right side) (the side surface at the right side) of the support plate 42 so as to correspond to the four toner containers 50, respectively. When the four toner containers 50 are mounted to the mounting portion 40, the projections 85 (see FIG. 6) at ends of the four toner containers 50 are supported by the respective attachment portions 47. When the projections 85 are supported by the attachment portions 47, the contact terminals 95 of the memory holders 90 are electrically conducted to contact terminals that are provided to the attachment portions 47 and that are not shown. The control portion 80 determines that the toner containers 50 are mounted to the mounting portion 40, by detecting conduction of these contact terminals.

As shown in FIGS. 6 and 7, four groove-like container guides 45 are provided on a left side surface 43A at one side (the left side) (the side surface at the left side) of the support plate 43 so as to extend obliquely upward. Each container guide 45 is formed in a groove shape obtained by recessing the left side surface 43A of the support plate 43 in the thickness direction thereof. In addition, each container guide 45 is formed in a shape in which the container guide 45 spreads at the upper end side of the support plate 43. The cover 69 (see FIG. 6) is mounted on a right end portion of the housing 51. The cover 69 is supported by the container guide 45.

As shown in FIG. 9, the toner container 50 has the toner discharge port 52 for discharging the toner within the housing 51 to the outside. The toner discharge port 52 is formed in the housing 51 of the toner container 50. The toner discharge port 52 is formed in a bottom portion (bottom surface) of the housing 51 and at one end portion, in the longitudinal direction, of the housing 51. That is, the toner discharge port 52 is formed in the right end portion of the bottom portion of the housing 51. A tubular portion 51A is formed on a side wall 51B (see FIG. 12) that is the right end portion of the housing 51. The tubular portion 51A is provided on a lower portion of the side wall 51B and is formed in a cylindrical shape projecting outward (rightward) from the side wall 51B. The internal space of the tubular portion 51A communicates with the storage chamber 57 of the housing 51. The tubular portion 51A is formed so as to be integrated with the housing 51. The toner discharge port 52 is formed in the peripheral surface of the tubular portion 51A. Specifically, the toner discharge port 52 is provided in a lower portion of the peripheral surface of the tubular portion 51A. The toner discharge port 52 is formed so as to penetrate downward a peripheral wall forming the peripheral surface of the tubular portion 51A.

When the toner container 50 is mounted to the mounting portion 40, the toner discharge port 52 is located at a position opposing a communication port (not shown) formed in the intermediate transfer unit 22 and is brought into close contact with the communication port. The toner is supplied from the communication port via a conveyance path, which is not shown, to the developing device 12. The mounting position of the toner container 50 in the mounting portion 40 is determined such that such a positional relationship is established.

Figure 10A:
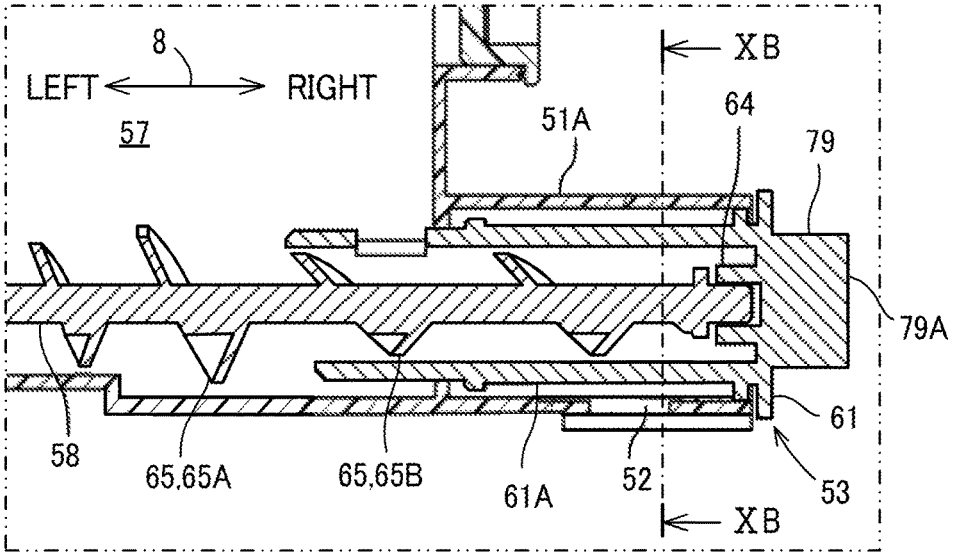
FIG. 10A is a partial cross-sectional view showing an opening/closing mechanism and a conveyance screw.
Figure 10B:
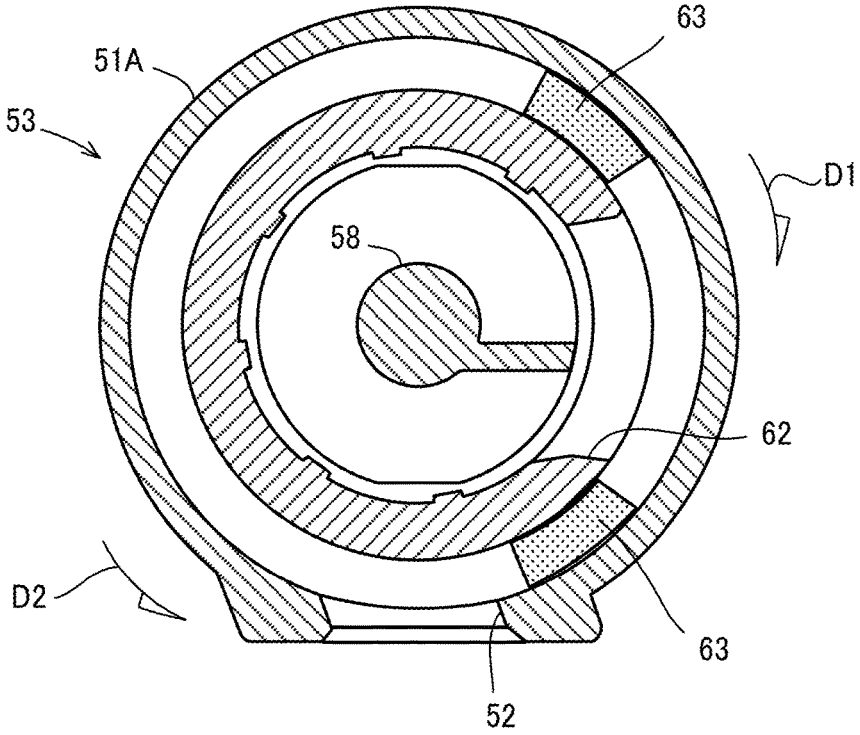
FIG. 10B is a cross-sectional view of a cross-section XB-XB in FIG. 10A.

The opening/closing mechanism 53 serves to open/close the toner discharge port 52 and is provided to the toner container 50. As shown in FIGS. 10A and 10B, the opening/closing mechanism 53 is provided within the tubular portion 51A. The opening/closing mechanism 53 has a cylinder-shaped shutter member 61 (an example of an opening/closing member) disposed within the tubular portion 51A, an opening portion 62, a sealing member 63, and a second connection portion 79. The opening portion 62 and the second connection portion 79 are formed so as to be integrated with the shutter member 61.

As shown in FIGS. 10A and 10B, the shutter member 61 has a cylinder portion 61A disposed in the internal space of the tubular portion 51A. The cylinder portion 61A is formed in a cylindrical shape concentric with the tubular portion 51A and is inserted in the tubular portion 51A. The cylinder portion 61A is mounted so as to be rotatable relative to the tubular portion 51A.

Figure 11A:
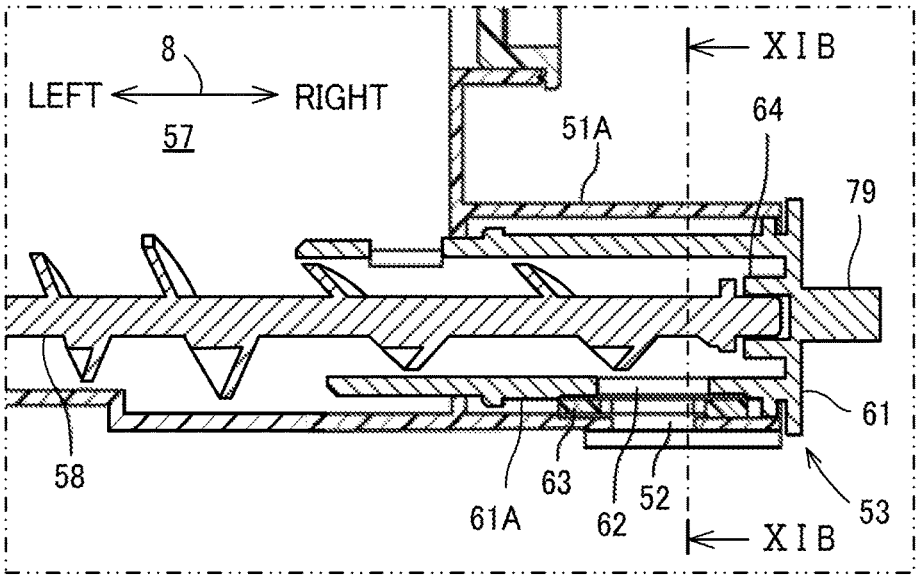
FIG. 11A is a partial cross-sectional view showing the opening/closing mechanism and the conveyance screw.
Figure 11B:
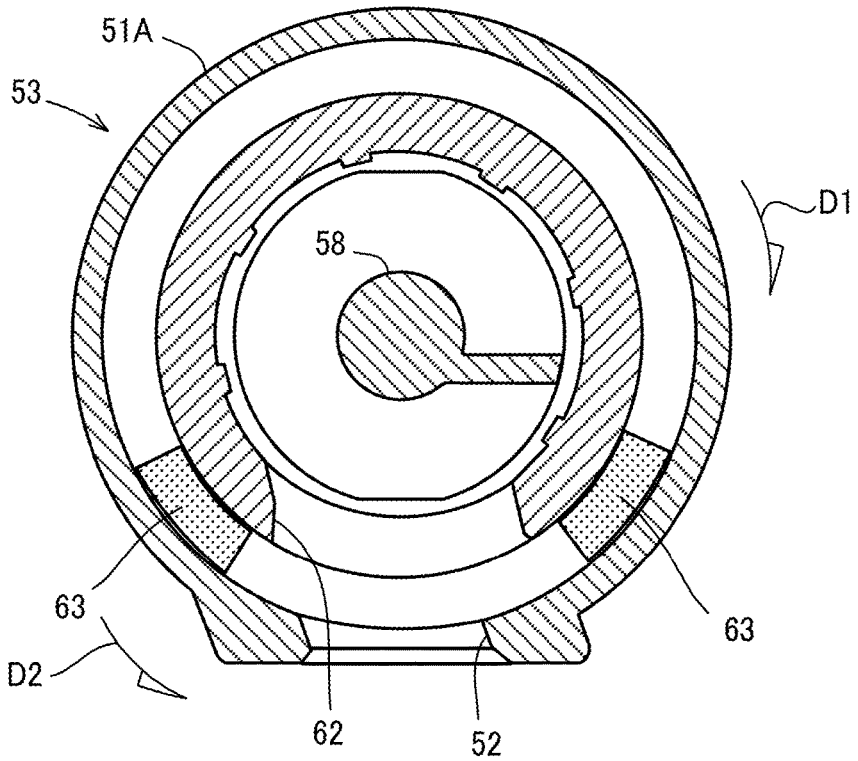
FIG. 11B is a cross-sectional view of a cross-section XIB-XIB in FIG. 11A.

The shutter member 61 is provided within the tubular portion 51A so as to be rotatable between a closing position (the position shown in FIGS. 10A and 10B) at which the shutter member 61 closes the toner discharge port 52 and an opening position (the position shown in FIGS. 11A and 11B) at which the shutter member 61 opens the toner discharge port 52. FIGS. 10A and 10B show a state where the toner discharge port 52 is closed by the shutter member 61. FIGS. 11A and 11B show a state where the toner discharge port 52 is opened by the shutter member 61.

The cylinder portion 61A is provided in the tubular portion 51A so as to be rotatable about the axis (center line) of the tubular portion 51A. While the shutter member 61 is located at the closing position, when rotational force in the direction of an arrow D1 (see FIG. 10B) is inputted to the shutter member 61, the shutter member 61 rotates and reaches the opening position from the closing position, so that the toner discharge port 52 is opened. In addition, while the shutter member 61 is located at the opening position, when rotational force in the direction of an arrow D2 (see FIG. 11B) opposite to the arrow D1 is inputted to the shutter member 61, the shutter member 61 rotates and reaches the closing position from the opening position, so that the toner discharge port 52 is closed.

As shown in FIG. 11A, the opening portion 62 is formed in the outer peripheral surface of the cylinder portion 61A of the shutter member 61. The opening portion 62 is formed at a position at which the opening portion 62 overlaps the toner discharge port 52 when the shutter member 61 is located at the opening position. In addition, the sealing member 63 serves to prevent scattering of the toner and is composed of an elastic member such as sponge. The sealing member 63 is fixed to the periphery of the opening portion 62 of the cylinder portion 61A and is in close contact with the inner peripheral surface of the tubular portion 51A. When the shutter member 61 rotates, the sealing member 63 also rotates in the same direction as the shutter member 61.

A bearing 64 is formed at the inner side of a right end portion of the shutter member 61. One end of the conveyance screw 58 is rotatably supported within the shutter member 61 by the bearing 64.

As shown in FIG. 9, the second connection portion 79 is provided so as to be integrated with the right end portion of the shutter member 61. The second connection portion 79 is provided on a side wall at the right side of the cylinder portion 61A and projects outward (rightward) from the side wall. The shutter member 61 is displaceable between the opening position and the closing position by the second connection portion 79 being rotated. The toner discharge port 52 is opened/closed by the shutter member 61 being rotated. The second connection portion 79 is a portion that connects to a second rotation portion 75 (see FIG. 15) of a later-described drive transmission mechanism 70 (see FIG. 17) and receives rotational force from the second rotation portion 75 when the toner container 50 is disposed at the mounting position in the mounting portion 40 and an operation lever 67 is located at a later-described first operation position (see FIG. 13A). That is, the second connection portion 79 is able to receive the rotational force from the drive transmission mechanism 70.

The second connection portion 79 is provided so as to be integrated with the shutter member 61 and is formed in a hook shape. The second connection portion 79 has an engagement rib 79A having a rib shape extending vertically downward in a state where the shutter member 61 is located at the closing position. In a state where the shutter member 61 is located at the closing position, when the shutter member 61 rotates between the closing position and the opening position, the second connection portion 79 rotates in the same direction as the shutter member 61 with the rotation of the shutter member 61. In the present embodiment, when the shutter member 61 is located at the closing position, the engagement rib 79A of the second connection portion 79 is in an attitude in which the engagement rib 79A is straight in a direction along the container guide 45. The direction is a direction in which the toner container 50 is guided by the container guide 45 in mounting the toner container 50 (an obliquely downward direction). In this state, when the toner container 50 is mounted to the mounting portion 40, the engagement rib 79A of the second connection portion 79 becomes insertable into a second connection groove 75B of the later-described second rotation portion 75.

When rotational force in the direction of the arrow D1 is inputted to the second connection portion 79, the rotational force is transmitted to the shutter member 61, and the shutter member 61 rotates in the same direction. When the shutter member 61 rotates to the opening position (the position shown in FIGS. 11A and 11B) at which the opening portion 62 overlaps the toner discharge port 52, the toner discharge port 52 is opened as shown in FIG. 11A. When the shutter member 61 rotates to the opening position and is held at this position, the toner within the housing 51 becomes dischargeable from the toner discharge port 52 to the outside. On the other hand, when rotational force in the direction of the arrow D2 is inputted to the second connection portion 79, the shutter member 61 rotates to the closing position (the position shown in FIGS. 10A and 10B) at which a peripheral wall portion of the shutter member 61 in which the opening portion 62 is not formed overlaps the toner discharge port 52, so that the toner discharge port 52 is closed by the peripheral wall of the cylinder portion 61A as shown in FIG. 10A.

As shown in FIG. 8, the operation portion 54 is provided to the housing 51 so as to be able to be operated by the user. The operation portion 54 is provided at the right end portion of the housing 51. The operation portion 54 is used for opening/closing the toner discharge port 52 in a state where the toner container 50 is mounted at the mounting position in the mounting portion 40. Specifically, the operation portion 54 is used for rotating the shutter member 61 between the opening position and the closing position. The operation portion 54 has a shaft portion 66, the operation lever 67 (an example of a lever member), and a first connection portion 78 that are formed so as to be integrated with each other. That is, the operation lever 67 is provided at the right end portion of the housing 51.

Figure 12:
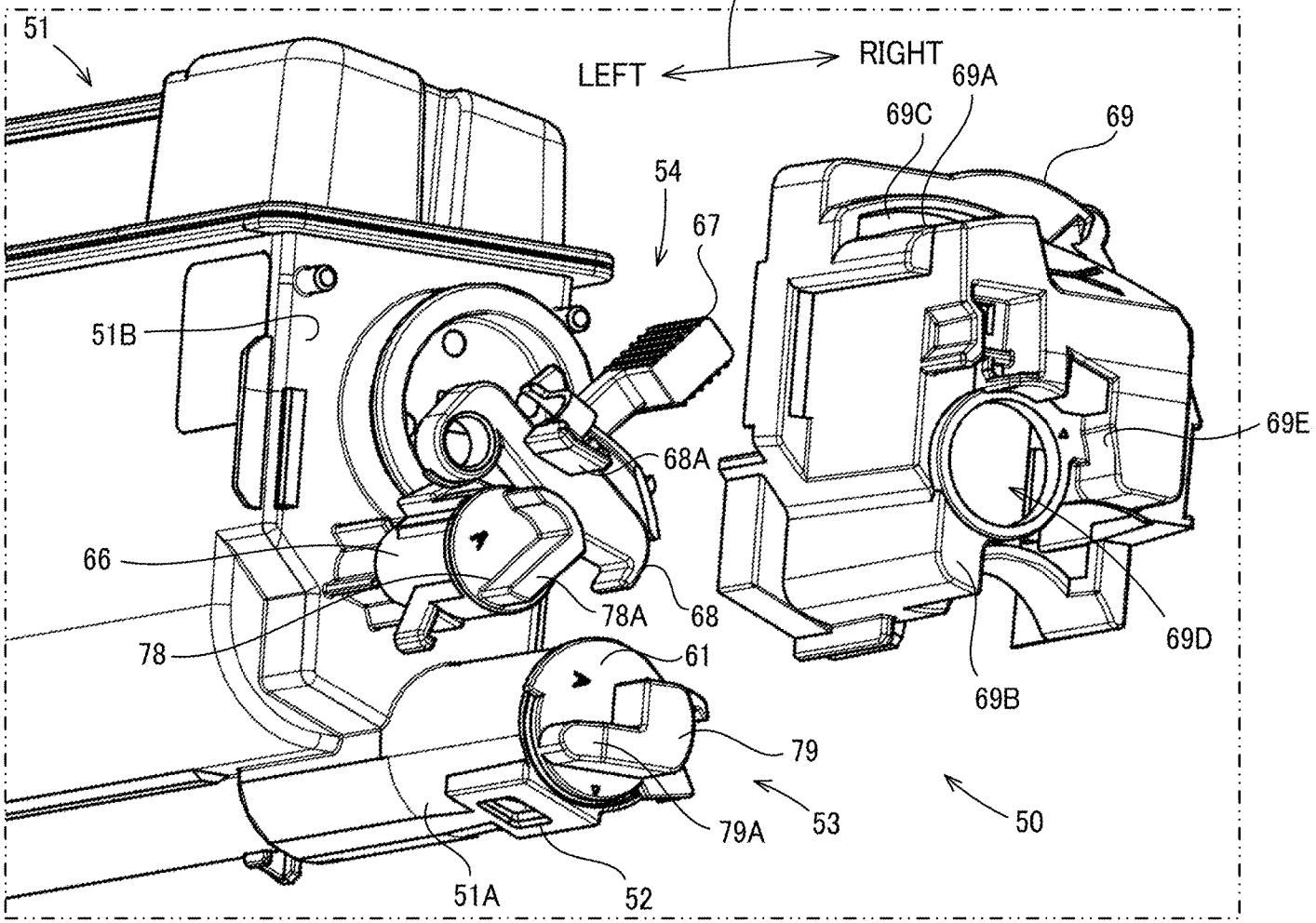
FIG. 12 is a diagram showing a state where a cover is removed from the right side end portion of the toner container.

As shown in FIG. 12, the shaft portion 66 has an axis projecting rightward from the right end portion of the housing 51. The operation lever 67 is rotatable integrally with the shaft portion 66 about the axis of the shaft portion 66. The operation lever 67 is a rod-like member extending from the shaft portion 66. In the present embodiment, the operation portion 54 is rotatable between the first operation position (the attitude shown in FIGS. 13A and 14A) at which the operation lever 67 is tilted frontward and a second operation position (the attitude shown in FIGS. 13B and 14B) at which the operation lever 67 is tilted rearward. When the operation lever 67 is operated between the first operation position and the second operation position, the shutter member 61 of the opening/closing mechanism 53 is moved to either the closing position corresponding to the first operation position or the opening position corresponding to the second operation position by the later-described drive transmission mechanism 70 (see FIG. 17). Here, the first operation position is an attitude corresponding to the closing position of the shutter member 61. Specifically, in the case of keeping the shutter member 61 at the closing position or displacing the shutter member 61 to the closing position, the operation lever 67 is located at the first operation position. Meanwhile, the second operation position is an attitude corresponding to the opening position of the shutter member 61. Specifically, in the case of keeping the shutter member 61 at the opening position or displacing the shutter member 61 to the opening position, the operation lever 67 is located at the second operation position.

A first locking member 68 is provided on the right end portion of the housing 51. The first locking member 68 serves to shift the operation portion 54 and the opening/closing mechanism 53 to a locked state such that the operation portion 54 and the opening/closing mechanism 53 are not operated by accident when the toner container 50 is not mounted. That is, the first locking member 68 inhibits the operation lever 67 of the operation portion 54 from being operated from the first operation position toward the second operation position, thereby shifting the operation portion 54 to the locked state at the first operation position. Furthermore, the first locking member 68 shifts the opening/closing mechanism 53 to the locked state at the closing position such that opening/closing movement of the opening/closing mechanism 53 is inhibited. A claw-like releasing portion 68A is formed on the first locking member 68 so as to be integrated therewith and project rightward. For example, when the operation lever 67 is located at the first operation position in a state where the toner container 50 is not mounted, the first locking member 68 is in contact with a projection that is provided so as to be integrated with the shaft portion 66 and that is not shown and a projection that is provided so as to be integrated with the shutter member 61 and that is not shown, thereby inhibiting the shaft portion 66 from rotating in the clockwise direction in FIG. 14A and inhibiting the shutter member 61 from rotating in the counterclockwise direction in FIG. 14A. The first locking member 68 is configured to be able to release the locked state of the operation portion 54 and the opening/closing mechanism 53 by being moved upward in FIG. 14A when the toner container 50 is located at the mounting position in the mounting portion 40.

Figure 13A:
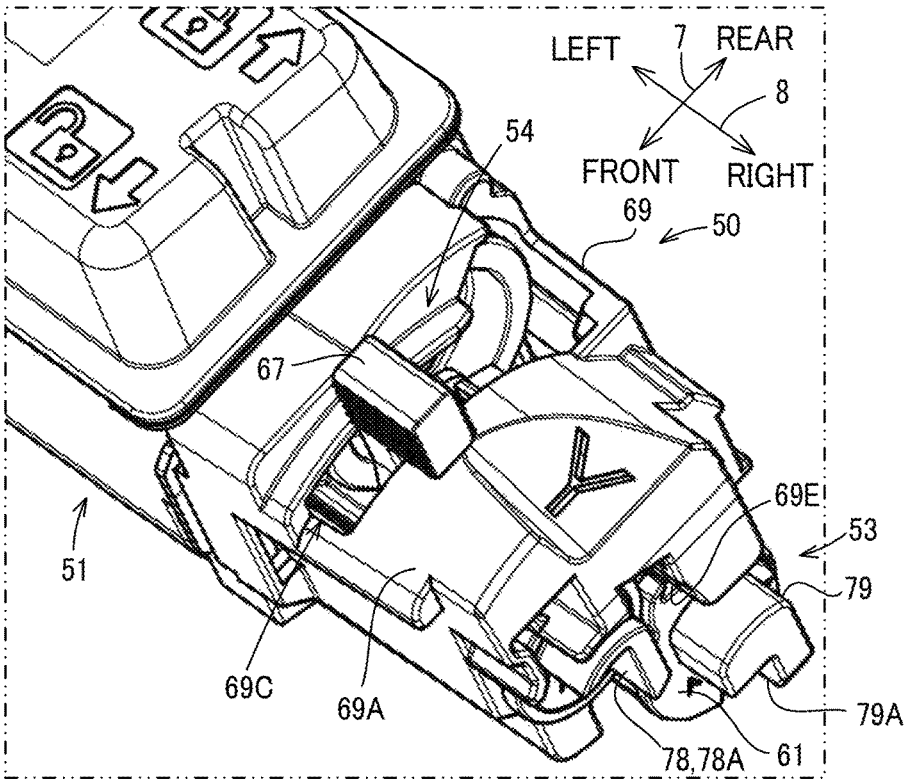
FIG. 13A is a diagram showing a state where an operation lever of an operation portion is located at a first operation position.
Figure 13B:
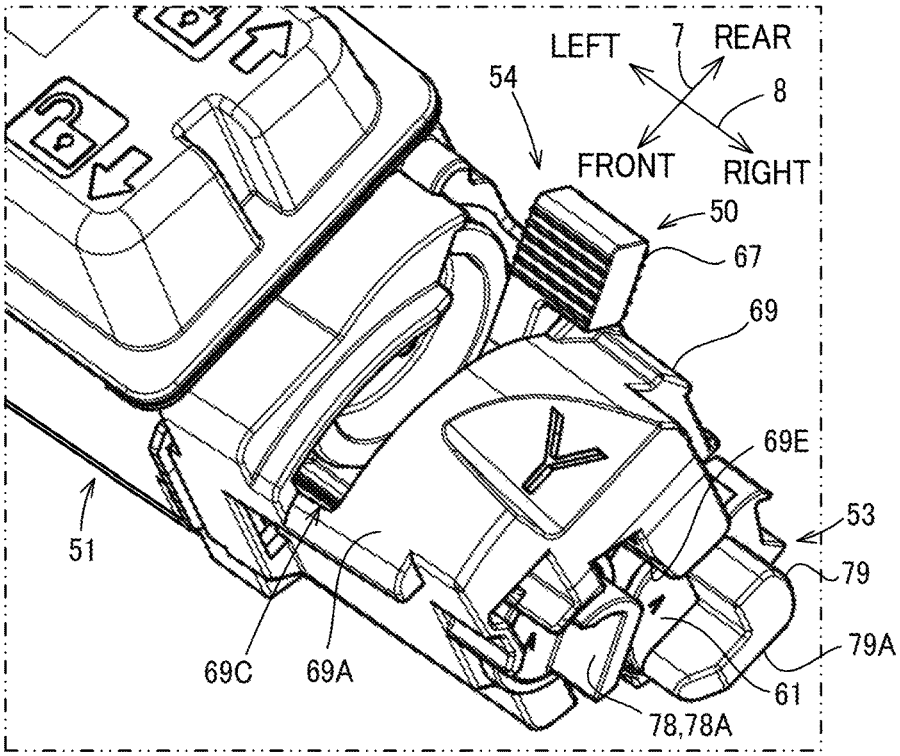
FIG. 13B is a diagram showing a state where the operation lever of the operation portion is located at a second operation position.

As shown in FIGS. 13A and 13B, the cover 69 is mounted on the side wall 51B (see FIG. 12), which is the right end portion of the housing 51. The cover 69 is mounted so as to cover a proximal end side portion of the operation lever 67, the first locking member 68, and the like. An arc-shaped slit 69C is formed in an upper surface 69A of the cover 69. The slit 69C is a through groove that extends in the front-rear direction 7 in the upper surface 69A and that has a shape elongated in the front-rear direction 7. The operation lever 67 is exposed upward from the slit 69C. Thus, by the operation lever 67 being operated, the operation lever 67 moves along the slit 69C and between the first operation position and the second operation position while being guided by the slit 69C.

Figure 14A:
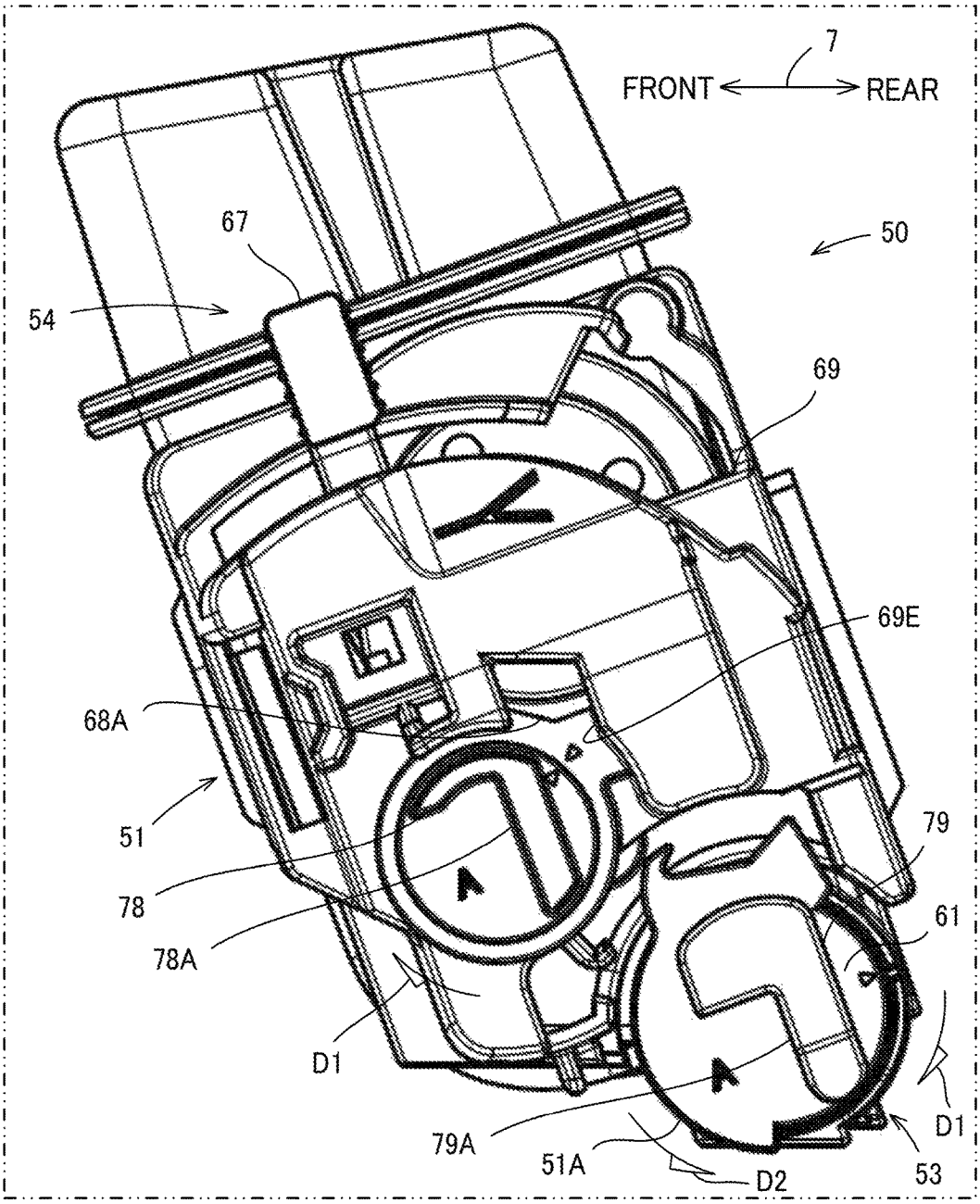
FIGS. 14A and 14B are diagrams showing positions of a first connection portion and a second connection portion corresponding to an operation position of the operation lever of the operation portion.

As shown in FIG. 12, an opening 69D is formed in a right side surface 69B of the cover 69. The later-described first connection portion 78 is exposed rightward from the opening 69D. In addition, a guide groove 69E is formed on the right side surface 69B so as to extend vertically and be open downward. As shown in FIG. 14A, the releasing portion 68A of the first locking member 68 is exposed from the cover 69 and at the guide groove 69E. The second connection portion 79 of the shutter member 61 is not covered with the cover 69.

Figure 15:
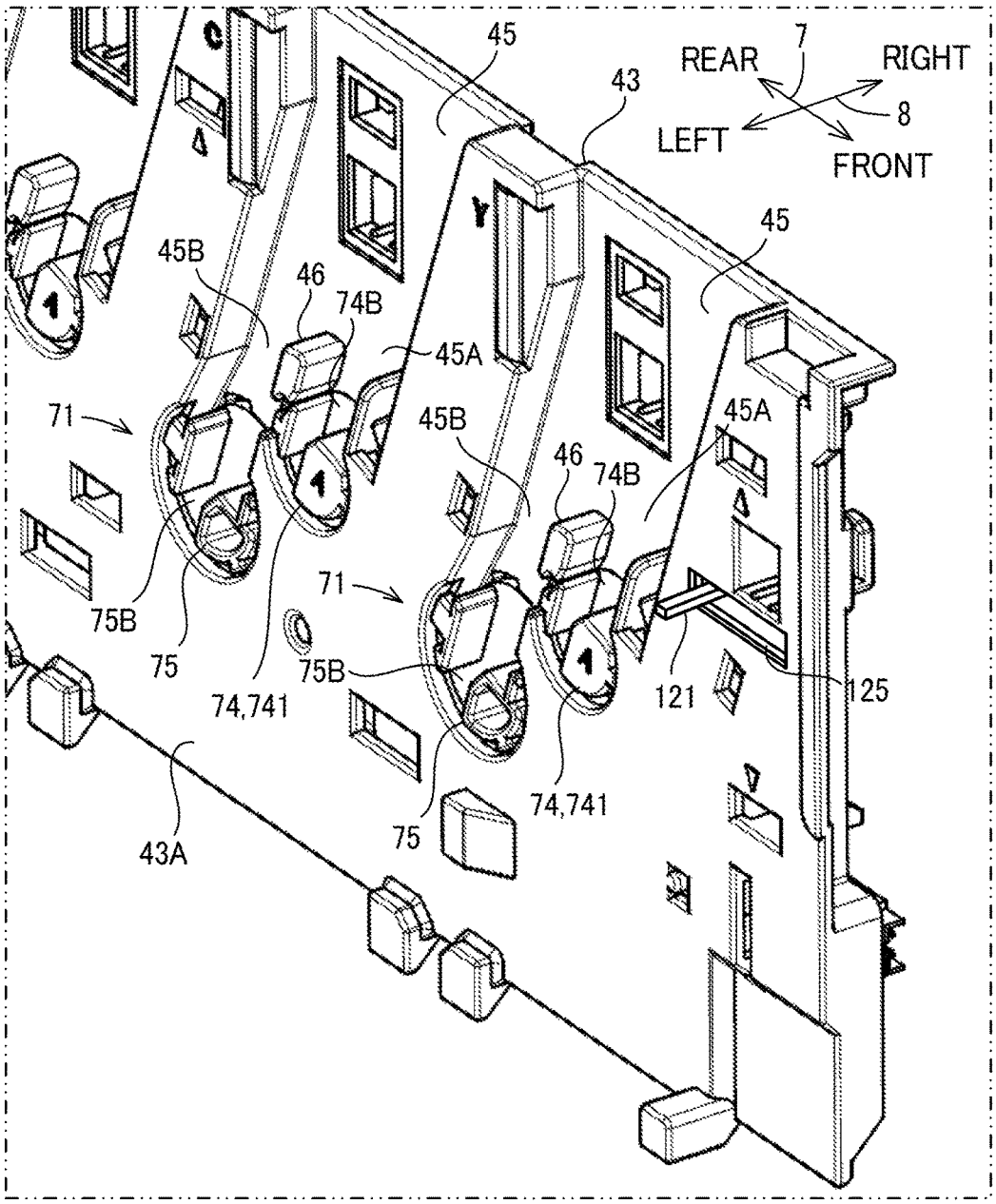
FIG. 15 is a diagram partially showing the configuration of the left side of the support plate of the mounting portion.

FIG. 15 is a perspective view showing the appearance of the support plate 43 as seen from the left side surface 43A. As shown in FIG. 15, container guides 45 are provided on the left side surface 43A of the support plate 43. A lower portion of each container guide 45 on the support plate 43 branches into a first groove portion 45A and a second groove portion 45B. A projection 46 is formed between the first groove portion 45A and the second groove portion 45B so as to extend along the first groove portion 45A and the second groove portion 45B.

In mounting the toner container 50, the cover 69 is guided by the container guide 45 in a mounting direction that is an obliquely downward direction. During the guiding, the projection 46 is inserted into the guide groove 69E of the cover 69. Thereafter, the upper end of the projection 46 comes into contact with the releasing portion 68A (see FIGS. 12 and 14A) of the first locking member 68 and presses the first locking member 68 upward. In this manner, when the toner container 50 is mounted to the support plate 43, the first locking member 68 comes into contact with the projection 46 and moves in an unlocking direction. Accordingly, the locked state of the operation portion 54 and the opening/closing mechanism 53 by the first locking member 68 is released.

[Drive Transmission Mechanisms 70]

The drive transmission mechanisms 70 are provided in the mounting portion 40. As shown in FIG. 17, the drive transmission mechanisms 70 are mounted on a right side surface 43B of the support plate 43. In the present embodiment, four drive transmission mechanisms 70 are provided so as to correspond to the four toner containers 50. The respective drive transmission mechanisms 70 are provided on the right side surface 43B of the support plate 43 so as to be aligned in the front-rear direction 7.

Figure 18:
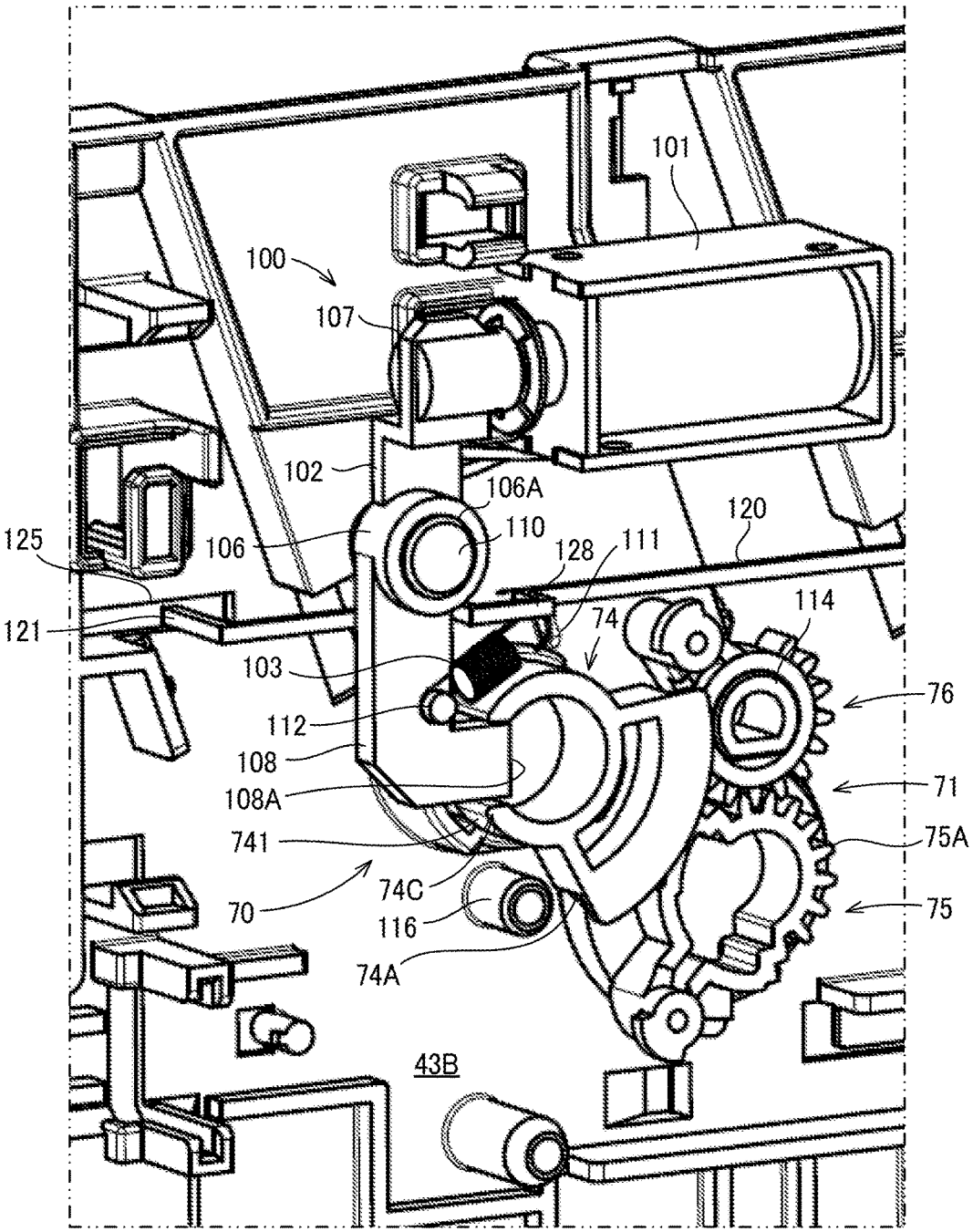
FIG. 18 is a diagram showing a drive transmission mechanism in an enlarged manner.
Figure 19:
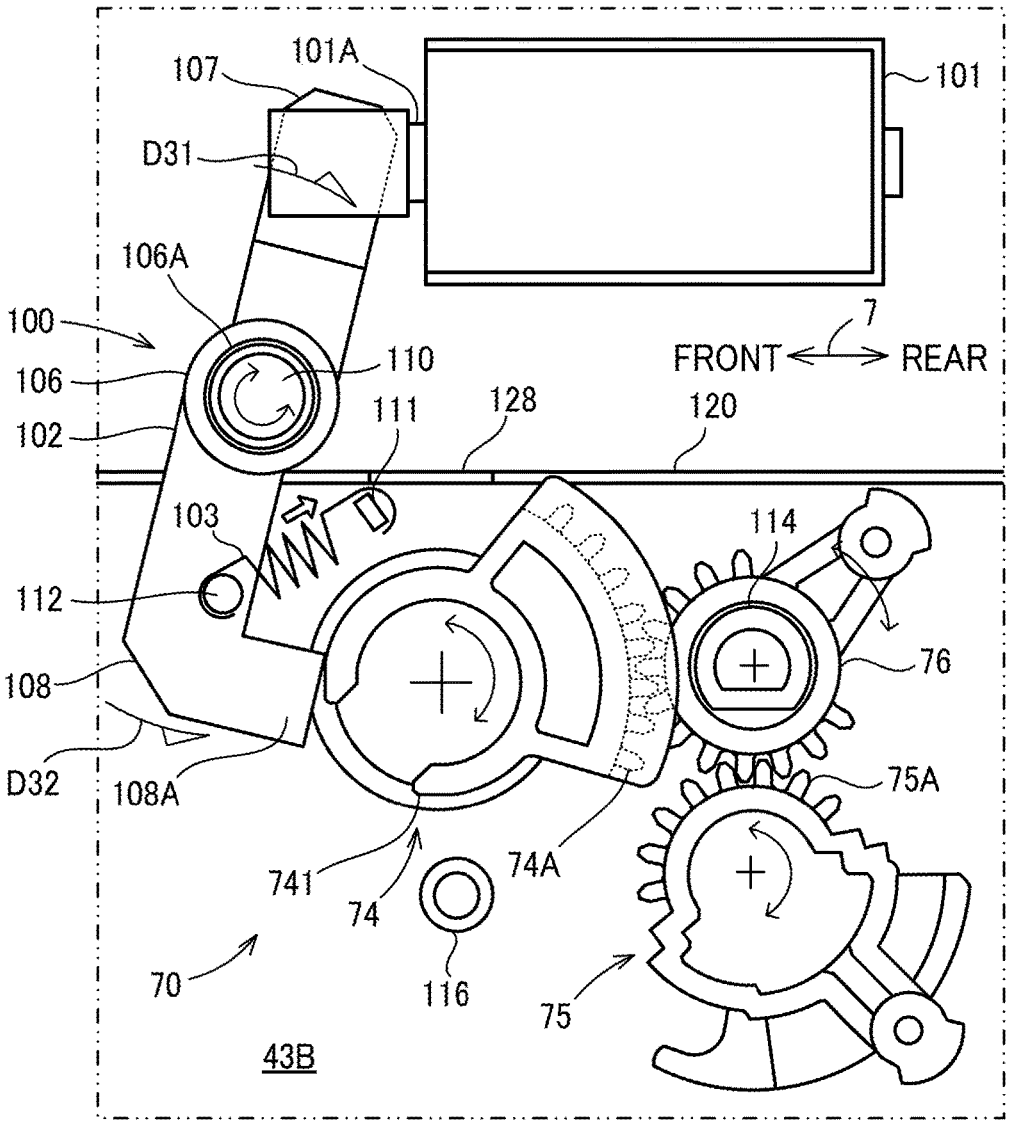
FIG. 19 is a schematic diagram illustrating operation of the drive transmission mechanism and shows the state of the drive transmission mechanism when the toner container is not mounted.
Figure 20:
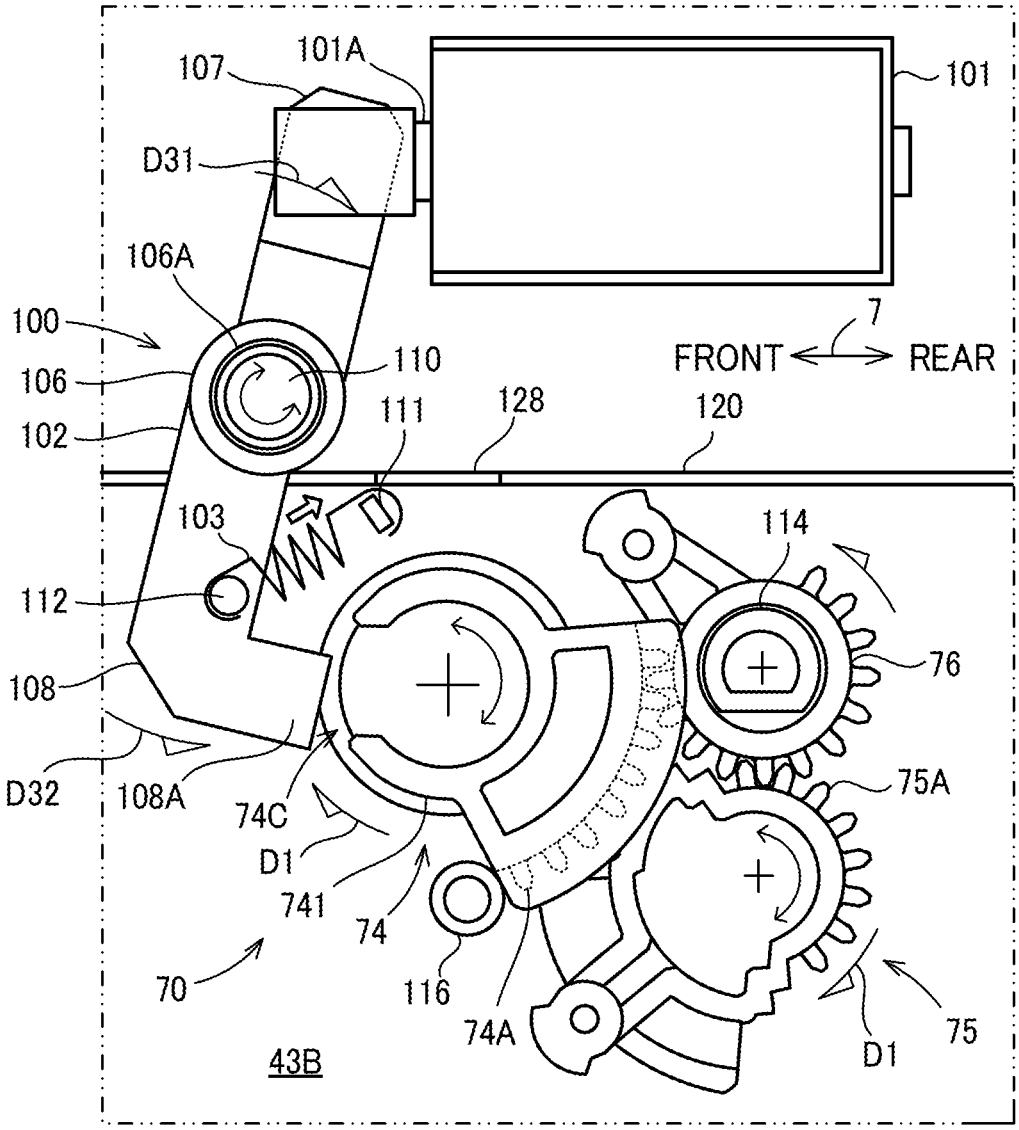
FIG. 20 is a schematic diagram illustrating operation of the drive transmission mechanism and shows a state when the toner container is mounted at a mounting position and the operation lever is operated to the second operation position.
Figure 21:
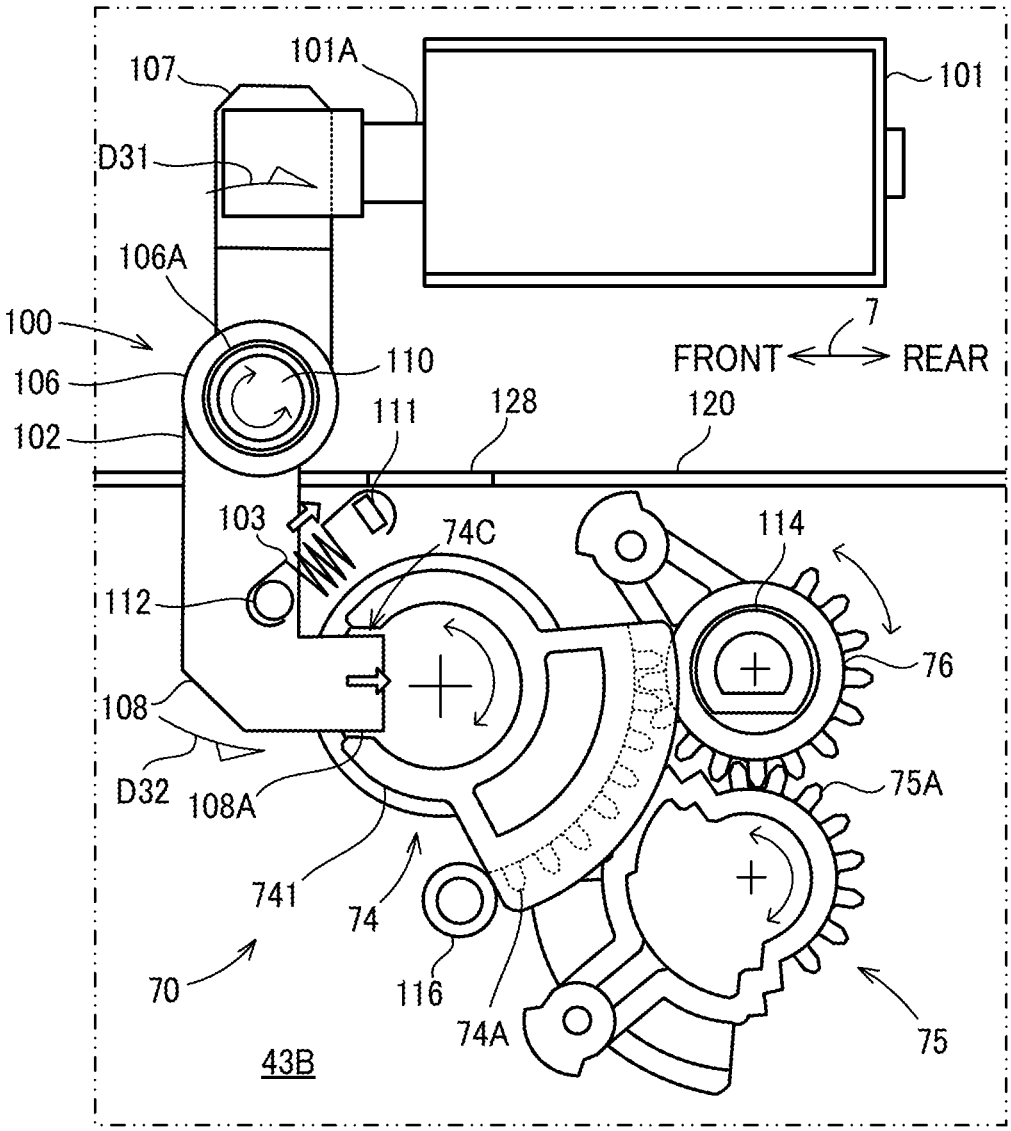
FIG. 21 is a schematic diagram illustrating operation of the drive transmission mechanism and shows a state when a second locking member locks the operation lever.
Figure 22:
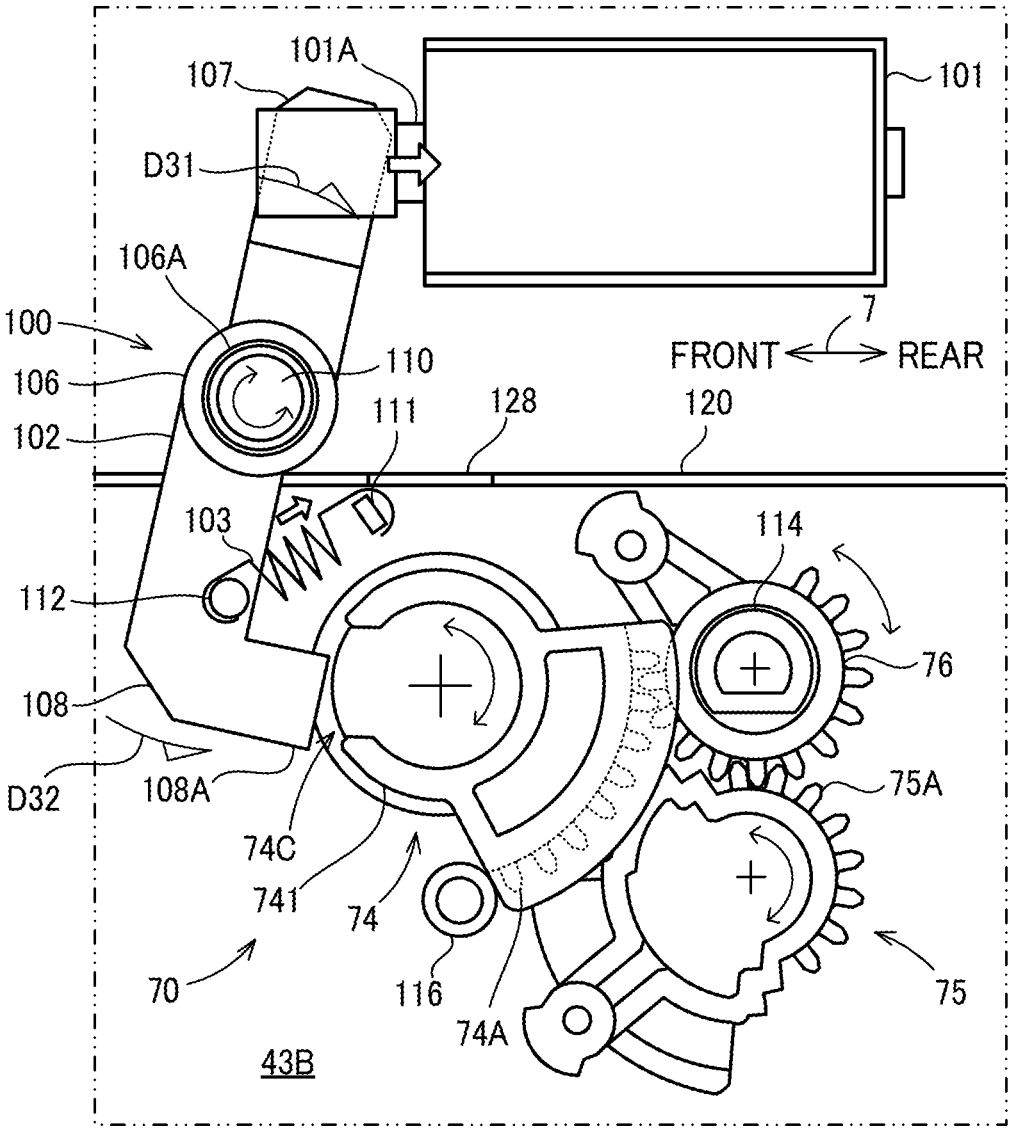
FIG. 22 is a schematic diagram illustrating operation of the drive transmission mechanism and shows a state where a solenoid is energized and the operation lever locked by a lever locking portion is unlocked.
Figure 23:
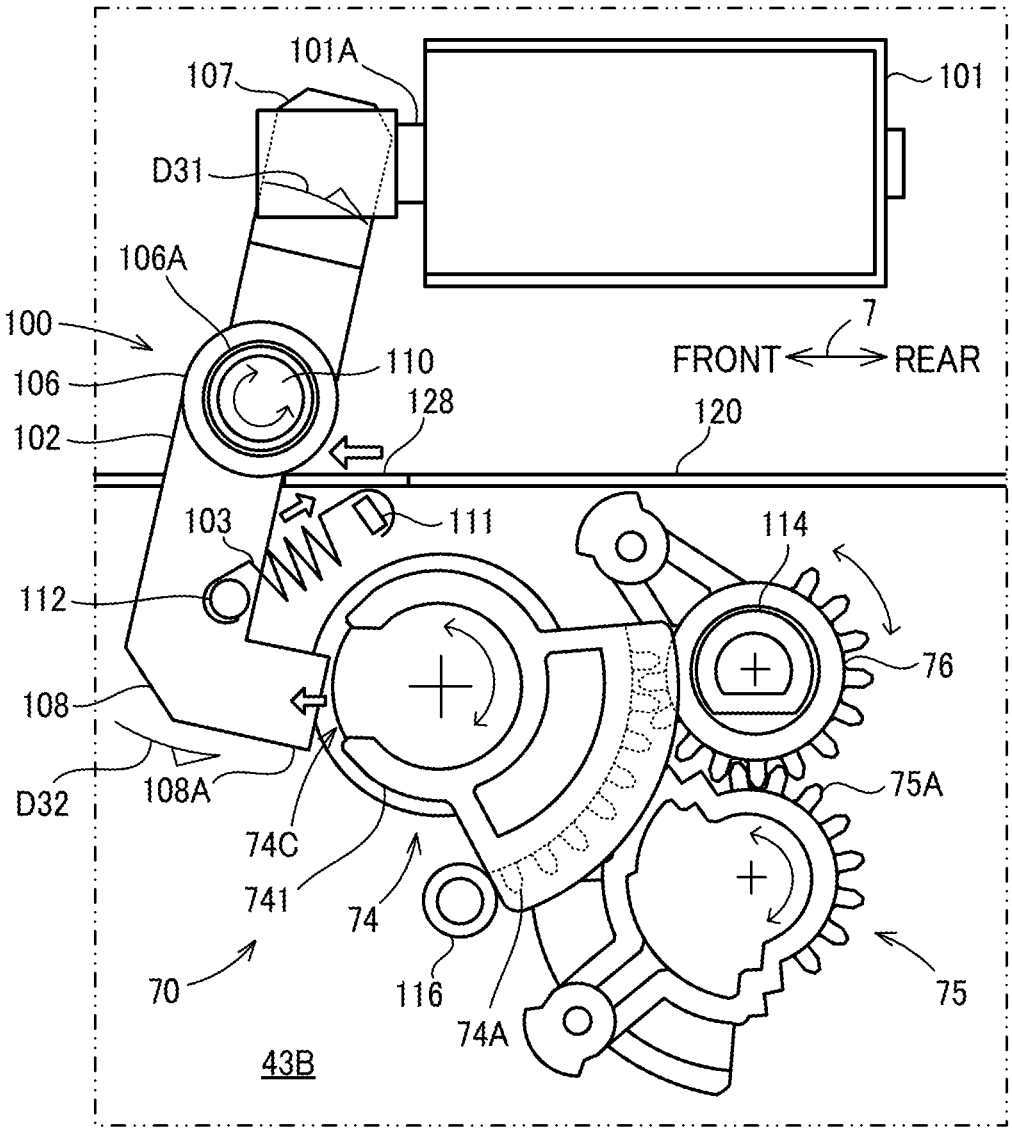
FIG. 23 shows a state where an unlocking member is operated and the operation lever locked by the lever locking portion is unlocked.

Hereinafter, the configurations of the drive transmission mechanisms 70 will be described with reference to the accompanying drawings. Here, FIGS. 16 to 18 are diagrams showing the drive transmission mechanisms 70. FIGS. 19 to 21 are schematic diagrams illustrating operation of the drive transmission mechanism 70. FIG. 16 is an enlarged view of the vicinity of one container guide 45 in FIG. 15. In addition, FIG. 17 is a perspective view of the support plate 43 as seen from the right side surface 43B. FIG. 18 is an enlarged view of the drive transmission mechanism 70 in FIG. 17. FIG. 19 shows a state when the toner container 50 is not mounted. FIG. 20 shows a state when the operation lever 67 is operated from the first operation position toward the second operation position in a state where the toner container 50 is mounted. FIG. 21 shows a state where the operation lever 67 is locked at the second operation position. FIG. 22 shows a state where the operation lever 67 is unlocked when the operation lever 67 is located at the second operation position.

Figure 17:
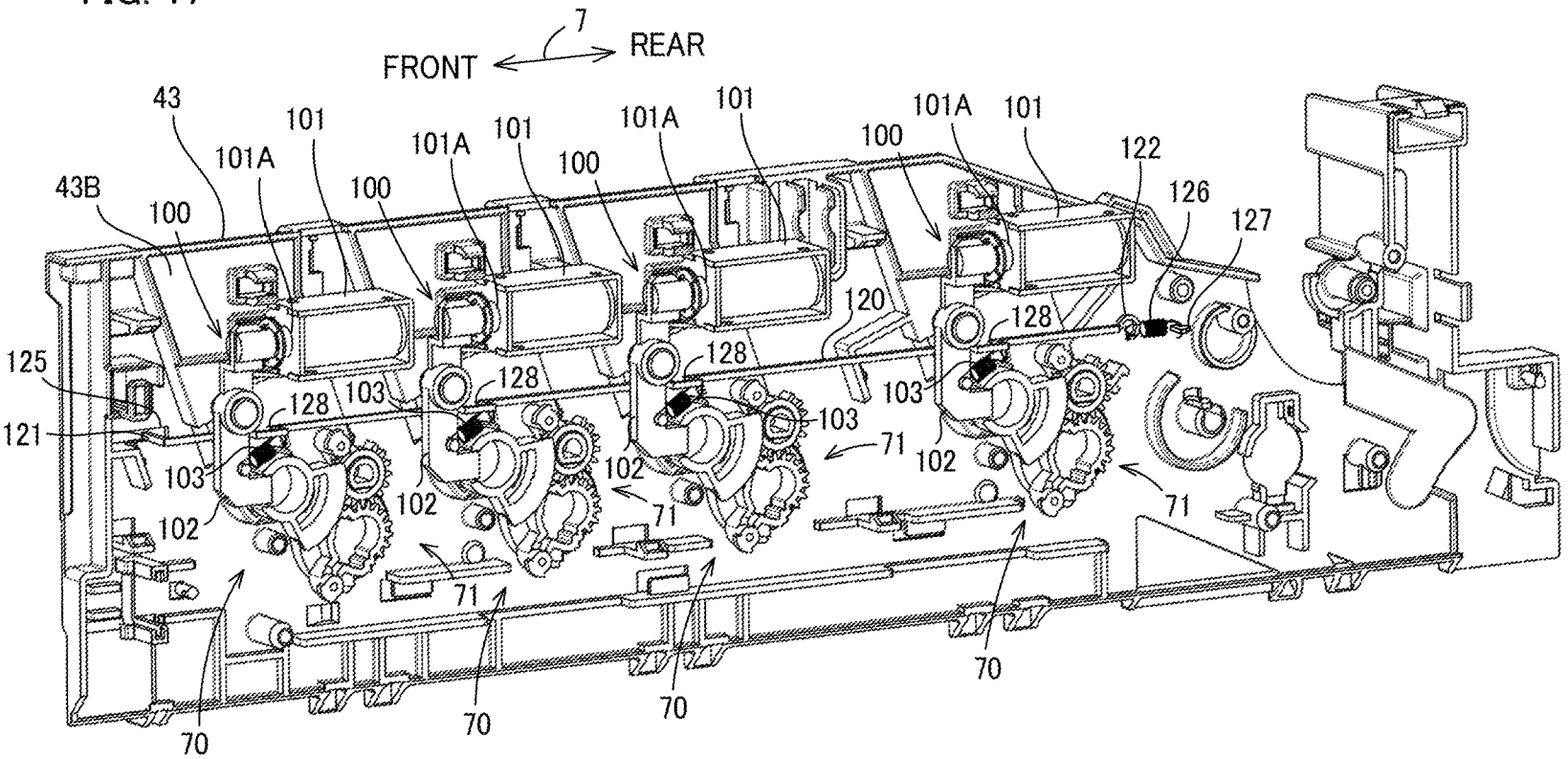
FIG. 17 is a diagram showing the configuration of the right side of the support plate of the mounting portion and shows drive transmission portions, etc.

As shown in FIG. 17, each drive transmission mechanism 70 includes a drive transmission portion 71 and a lever locking portion 100.

[Drive Transmission Portion 71]

The drive transmission portion 71 is configured to transmit operation driving force (an example of operating force) inputted by operation of the operation lever 67 of the operation portion 54, to the shutter member 61 of the opening/closing mechanism 53, in a state where the toner container 50 is located at the mounting position in the mounting portion 40.

As shown in FIG. 17, the drive transmission portion 71 has a first rotation portion 74 (an example of an input portion), the second rotation portion 75 (an example of an output portion), and an intermediate rotation portion 76. The first rotation portion 74 is a portion that receives the operation driving force inputted by the operation lever 67 when the operation lever 67 of the operation portion 54 is operated in a state where the toner container 50 is located at the mounting position. In addition, the second rotation portion 75 serves to output (transmit) the operation driving force transmitted from the first rotation portion 74 when the operation lever 67 is operated, to the outside (the shutter member 61 of the opening/closing mechanism 53).

The first rotation portion 74 is disposed at a lower end portion of the first groove portion 45A of the container guide 45 and is supported by the support plate 43 so as to be rotatable upon reception of the operation driving force. A circular opening 45A1 (see FIG. 16A) is formed in the lower end portion of the first groove portion 45A so as to penetrate the support plate 43, and a part (a later-described first connection groove 74B) of the first rotation portion 74 is exposed on the left side surface 43A of the support plate 43 from the opening 45A1. Meanwhile, the second rotation portion 75 is disposed at a lower end portion of the second groove portion 45B and is supported by the support plate 43 so as to be rotatable in conjunction with the first rotation portion 74. A circular opening 45B1 (see FIG. 16A) is formed in the lower end portion of the second groove portion 45B so as to penetrate the support plate 43, and a part (the later-described second connection groove 75B) of the second rotation portion 75 is exposed on the left side surface 43A of the support plate 43 from the opening 45B1.

As shown in FIG. 18, the first rotation portion 74 has a support portion 741 and a first gear portion 74A (see FIG. 19). The support portion 741 of the first rotation portion 74 is a portion rotatably supported by the support plate 43 and is formed in a cylindrical shape with a hollow interior. The first gear portion 74A is a sector-shaped member projecting from the outer peripheral surface of the support portion 741 in a direction parallel to the right side surface 43B and has a circular-arc-shaped rack gear at a projecting end portion thereof. The support portion 741 and the first gear portion 74A are formed so as to be integrated with the first rotation portion 74.

A locking groove 74C into which a hook portion 108A of the later-described second locking member 102 is insertable is formed on the support portion 741 of the first rotation portion 74. When the operation lever 67 is operated from the first operation position toward the second operation position, and the first rotation portion 74 rotates to a later-described second position (the position shown in FIGS. 20 and 21) corresponding to the second operation position of the operation lever 67 due to this operation, the locking groove 74C opposes the hook portion 108A, so that the hook portion 108A becomes insertable into the locking groove 74C. Here, the operation of the operation lever 67 being rotated from the first operation position toward the second operation position corresponds to a locking operation of the present disclosure.

The second rotation portion 75 also has a second gear portion 75A. The second gear portion 75A is formed so as to be integrated with the second rotation portion 75.

The intermediate rotation portion 76 is a spur wheel having a gear at the outer peripheral surface thereof. The intermediate rotation portion 76 is rotatably supported on a rotation shaft 114 that is erected on the right side surface 43B and that has a D cross-sectional shape. The intermediate rotation portion 76 is in mesh with the first gear portion 74A and the second gear portion 75A. The first gear portion 74A and the second gear portion 75A are not in mesh with each other. That is, the first gear portion 74A and the second gear portion 75A are indirectly in mesh with each other via the intermediate rotation portion 76.

Since the drive transmission portion 71 is configured as described above, when the first rotation portion 74 rotates, the rotational force of the first rotation portion 74 is transmitted via the intermediate rotation portion 76 to the second rotation portion 75, and the second rotation portion 75 rotates in the same rotation direction as the rotation direction of the first rotation portion 74.

As shown in FIGS. 13A to 14B, the operation portion 54 of the toner container 50 has the first connection portion 78. The first connection portion 78 rotates by the operation portion 54 being operated. The first connection portion 78 is formed so as to be integrated with the operation lever 67. Specifically, the first connection portion 78 is formed so as to be integrated with a right end portion of the shaft portion 66. The first connection portion 78 projects rightward from the right end surface of the shaft portion 66 and is formed in a hook shape. The first connection portion 78 has an engagement rib 78A having a rib shape extending vertically downward in a state where the operation lever 67 is located at the first operation position. The engagement rib 78A extends in the mounting direction (that is, the obliquely downward direction), in which the toner container 50 is guided by the container guide 45 in mounting the toner container 50, in a state where the operation lever 67 is located at the first operation position (see FIG. 14A). When the toner container 50 is mounted to the container guide 45 of the support plate 43 in a state where the operation lever 67 is located at the first operation position, the engagement rib 78A is connected to the first rotation portion 74 of the drive transmission portion 71. That is, the first connection portion 78 connects to the first rotation portion 74 in a state where the toner container 50 is located at the mounting position. Accordingly, the operation driving force inputted when the operation lever 67 is operated becomes capable of being transmitted to the first rotation portion 74.

Figure 16A:
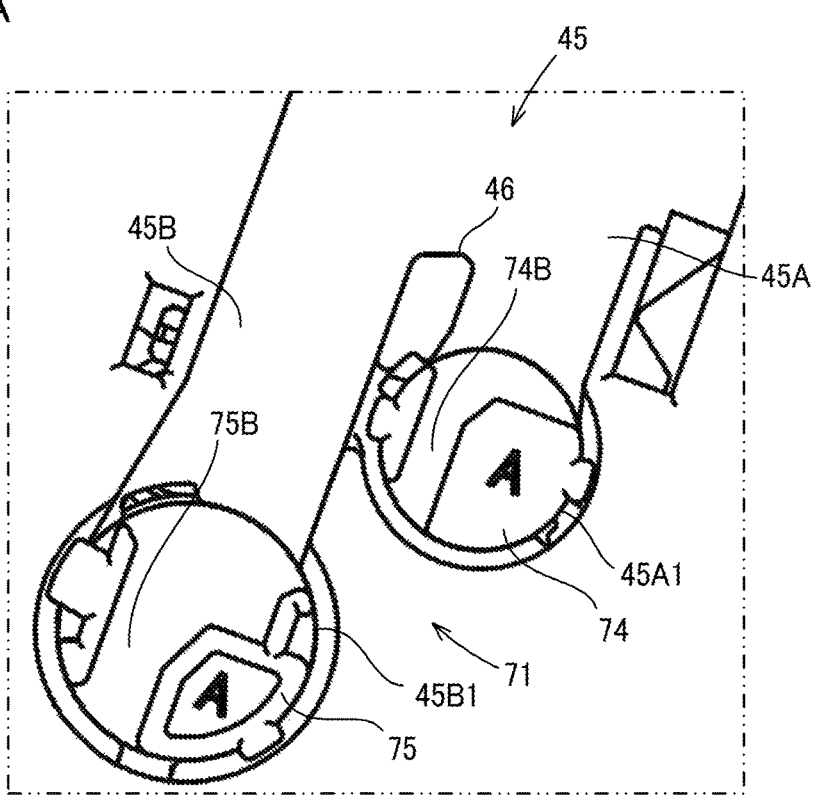
FIGS. 16A and 16B are enlarged views of a main part of the configuration of the left side of the support plate of the mounting portion.
Figure 16B:
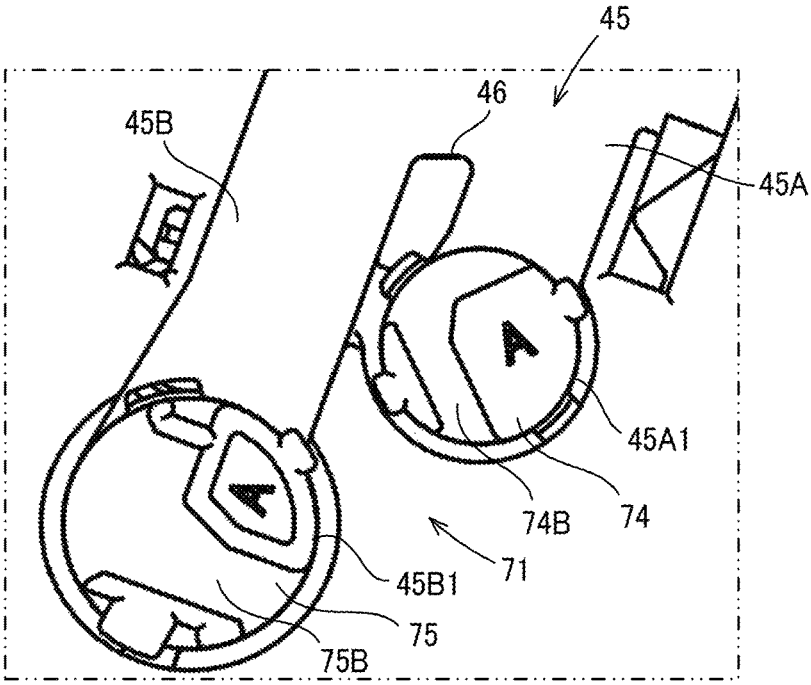

As shown in FIGS. 16A and 16B, the first rotation portion 74 of the drive transmission portion 71 has the first connection groove 74B (an example of a first engagement groove). The first connection groove 74B is formed on a left side end portion of the support portion 741. The first connection portion 78 of the toner container 50 is connected to the first connection groove 74B. At least a part of the first connection groove 74B extends straight. Meanwhile, the engagement rib 78A (see FIG. 14A) of the first connection portion 78 has a shape that allows the engagement rib 78A to be inserted into and engaged with the first connection groove 74B. That is, the groove width of the first connection groove 74B is substantially equal to the thickness of the engagement rib 78A. When the housing 51 is mounted to the mounting portion 40, the engagement rib 78A of the first connection portion 78 is inserted into the first connection groove 74B and connected to the first rotation portion 74 so as to be rotatable integrally therewith.

As shown in FIGS. 13A to 14B, the shutter member 61 of the opening/closing mechanism 53 has the second connection portion 79 that rotates integrally with the shutter member 61. The second connection portion 79 is formed so as to be integrated with the right end portion of the shutter member 61. The second connection portion 79 projects rightward from the right end surface of the shutter member 61 and is formed in a hook shape. The second connection portion 79 is a portion that receives the operation driving force from the second rotation portion 75 of the drive transmission portion 71. The second connection portion 79 has the engagement rib 79A having a rib shape extending straight. The engagement rib 79A extends in the mounting direction, in which the toner container 50 is guided by the container guide 45 in mounting the toner container 50, in a state where the operation lever 67 is located at the first operation position (see FIG. 14A). When the toner container 50 is mounted to the container guide 45 of the support plate 43 in a state where the operation lever 67 is located at the first operation position, the engagement rib 79A is connected to the second rotation portion 75 of the drive transmission portion 71. That is, the second connection portion 79 connects to the second rotation portion 75 in a state where the toner container 50 is located at the mounting position. Accordingly, the operation driving force becomes capable of being transmitted via the first rotation portion 74 and the second rotation portion 75 to the second connection portion 79.

As shown in FIGS. 16A and 16B, the second rotation portion 75 of the drive transmission portion 71 has the second connection groove 75B (an example of a second engagement groove). The second connection groove 75B is formed on a left side end portion of the second rotation portion 75. The second connection portion 79 of the toner container 50 is connected to the second connection groove 75B. At least a part of the second connection groove 75B extends straight. Meanwhile, the engagement rib 79A (see FIG. 14A) of the second connection portion 79 has a shape that allows the engagement rib 79A to be inserted into and engaged with the second connection groove 75B. That is, the groove width of the second connection groove 75B is substantially equal to the thickness of the engagement rib 79A. When the housing 51 is mounted to the mounting portion 40, the engagement rib 79A of the second connection portion 79 is inserted into the second connection groove 75B and connected to the second rotation portion 75 so as to be rotatable integrally therewith. The shutter member 61 of the opening/closing mechanism 53 is configured to receive rotational force of the second connection portion 79 and rotate by the second connection portion 79 rotating integrally with the second rotation portion 75, thereby opening/closing the toner discharge port 52.

[Lever Locking Portion 100]

The lever locking portion 100 is configured to lock, at the second operation position, the operation lever 67 located at the second operation position, in a state where the toner container 50 is mounted to the mounting portion 40. As shown in FIG. 18, the lever locking portion 100 is mounted on the right side surface 43B of the support plate 43.

The lever locking portion 100 includes the above-described solenoid 101, the second locking member 102, and a coil spring 103 as a biasing member.

The solenoid 101 serves to provide driving force to the second locking member 102. As shown in FIGS. 17 and 18, the solenoid 101 is provided above the first rotation portion 74. In addition, the solenoid 101 is mounted on the right side surface 43B of the support plate 43 such that the plunger 101A thereof is disposed at the front side of the solenoid body and the operation direction of the plunger 101A coincides with the front-rear direction 7. The solenoid 101 operates by energization thereof being controlled by the control portion 80 (see FIG. 5). In the present embodiment, the solenoid 101 is exemplified as an example of the drive portion of the present disclosure, but a motor may be used instead of the solenoid 101. When the control portion 80 determines that the remaining amount of the toner in the toner container 50 is in the empty state, on the basis of a detection signal sent from the remaining amount sensor 87, the control portion 80 energizes the solenoid 101 to operate the solenoid 101 to retract the plunger 101A into the solenoid body. On the other hand, when the control portion 80 determines that the remaining amount of the toner in the toner container 50 is not in the empty state, the control portion 80 does not energize the solenoid 101 and does not operate the solenoid 101. In this case, the plunger 101A of the solenoid 101 becomes free.

As shown in FIG. 18, the second locking member 102 is formed in an arm shape extending straight, and has: a rotation support portion 106 that is formed at a center portion thereof; a fixed portion 107 that extends from the rotation support portion 106 to one side; and a rotation portion 108 that extends from the rotation support portion 106 to the other side. The rotation support portion 106 has an inner hole 106A formed in a circular tubular shape. A rotation shaft 110 is provided on the support plate 43 so as to project from the right side surface 43B. The rotation shaft 110 is provided at the front side and at the upper side with respect to the first rotation portion 74. The inner hole 106A of the rotation support portion 106 is rotatably supported on the rotation shaft 110. Accordingly, the second locking member 102 is rotatable (displaceable) between a later-described lever locking position and a later-described lever releasing position.

The second locking member 102 is disposed so as to extend substantially in the up-down direction 6 in a state where the rotation support portion 106 is supported on the rotation shaft 110. In this state, the rotation portion 108 of the second locking member 102 is disposed at the front side of the first rotation portion 74. The fixed portion 107 extends upward from the rotation support portion 106, and the upper end thereof is connected to the plunger 101A of the solenoid 101. Thus, when the solenoid 101 is energized and the plunger 101A is retracted into the solenoid body, the fixed portion 107 also moves in the retraction direction in which the plunger 101A is retracted. By receiving force in the retraction direction of the plunger 101A at this time, the second locking member 102 rotates in the direction of an arrow D31 in FIG. 19 (the clockwise direction in FIG. 19).

The rotation portion 108 extends downward from the rotation support portion 106. The hook portion 108A having a hook shape is formed on a lower end portion of the rotation portion 108. In the present embodiment, when the first rotation portion 74 rotates to the position (the position shown in FIGS. 14B and 16B) corresponding to the second operation position of the operation lever 67, the locking groove 74C opposes the hook portion 108A. At this time, when the second locking member 102 rotates in the direction of an arrow D32 in FIG. 19 (the counterclockwise direction in FIG. 19), the hook portion 108A is inserted into the locking groove 74C and inhibits rotation of the first rotation portion 74. That is, the hook portion 108A locks the first rotation portion 74 such that the first rotation portion 74 cannot rotate. By rotation of the first rotation portion 74 being inhibited, operation of the operation lever 67 is also locked. Therefore, when the hook portion 108A is inserted into the locking groove 74C, the operation lever 67 is locked at the second operation position.

The coil spring 103 is a so-called tension spring. The coil spring 103 provides force that rotates the second locking member 102 in the direction of the arrow D32 in FIG. 19. The coil spring 103 is hooked at one end thereof on a fixing piece 111 provided on the right side surface 43B and is hooked at another end thereof on a boss 112 provided on the rotation portion 108. Accordingly, the coil spring 103 provides elastic biasing force that rotates the rotation portion 108 in the direction of the arrow D32, to the rotation portion 108 to bias the hook portion 108A of the second locking member 102 to the first rotation portion 74 side. Here, the biasing force of the coil spring 103 is smaller than the operating force generated when the solenoid 101 is energized. Thus, when the solenoid 101 is energized and force that retracts the plunger 101A into the solenoid body acts, the second locking member 102 rotates in the direction of the arrow D31 in FIG. 19 against the spring force of the coil spring 103.

[Operation of Drive Transmission Portion 71]

Before the toner container 50 is mounted to the mounting portion 40 of the apparatus body 28, the toner discharge port 52 is closed by the shutter member 61, and the operation lever 67 and the opening/closing mechanism 53 are shifted to the locked state by the first locking member 68. At this time, the operation lever 67 is located at the first operation position, and the shutter member 61 is located at the closing position. In addition, each of the first connection portion 78 and the second connection portion 79 extends in the mounting direction (that is, the obliquely downward direction), in which the cover 69 is guided by the container guide 45, as shown in FIG. 14A. Moreover, the respective rotation portions 74 to 76 of the drive transmission portion 71 are located at the positions shown in FIG. 19. That is, the first rotation portion 74 is located at a first position (the position shown in FIG. 19) at which the locking groove 74C does not oppose the hook portion 108A and the hook portion 108A cannot be inserted into the locking groove 74C. In addition, the solenoid 101 is not energized, and the plunger 101A is in a free state.

Before the toner container 50 is mounted to the mounting portion 40, the first connection groove 74B of the first rotation portion 74 and the second connection groove 75B of the second rotation portion 75 in the drive transmission portion 71 extend in the direction in which the container guide 45 extends (that is, the same direction as the mounting direction in which the cover 69 is guided) as shown in FIG. 16A.

In the case of mounting the toner container 50 to the mounting portion 40, the cover 69 is inserted into the container guide 45 of the support plate 43, and the memory holder 90 is inserted into the attachment portion 47 of the support plate 42.

At the container guide 45, the cover 69 of the toner container 50 is guided obliquely downward by the container guide 45. When the cover 69 reaches the lower end of the container guide 45, the engagement rib 78A of the first connection portion 78 becomes inserted into and engaged with the first groove portion 45A, and the engagement rib 79A of the second connection portion 79 becomes inserted into and engaged with the second groove portion 45B. Accordingly, the engagement rib 78A is connected to the first connection groove 74B of the first rotation portion 74, and the engagement rib 79A is connected to the second connection groove 75B of the second rotation portion 75.

In addition, while the cover 69 is guided by the container guide 45, the upper end of the projection 46 comes into contact with the releasing portion 68A of the first locking member 68 and presses the first locking member 68 upward. Accordingly, in a state where the first connection portion 78 is connected to the first rotation portion 74 and the second connection portion 79 is connected to the second rotation portion 75, the locked state of each of the operation lever 67 and the opening/closing mechanism 53 by the first locking member 68 is released. The operation lever 67 becomes rotatable from the first operation position to the second operation position.

When the operation lever 67 is rotated (operated) from the first operation position (see FIG. 14A) to the second operation position (see FIG. 14B) in a state where the locked state by the first locking member 68 is released, the toner discharge port 52 is opened. Specifically, when the operation lever 67 is rotated from the first operation position to the second operation position in a state where the toner container 50 is mounted to the mounting portion 40, the shaft portion 66 and the first connection portion 78 of the operation portion 54 rotate integrally with the operation lever 67 in the clockwise direction indicated by the arrow D1 (see FIG. 14B). At this time, the first connection portion 78 rotates by the same angle as the rotation angle of the operation lever 67.

Figure 14B:
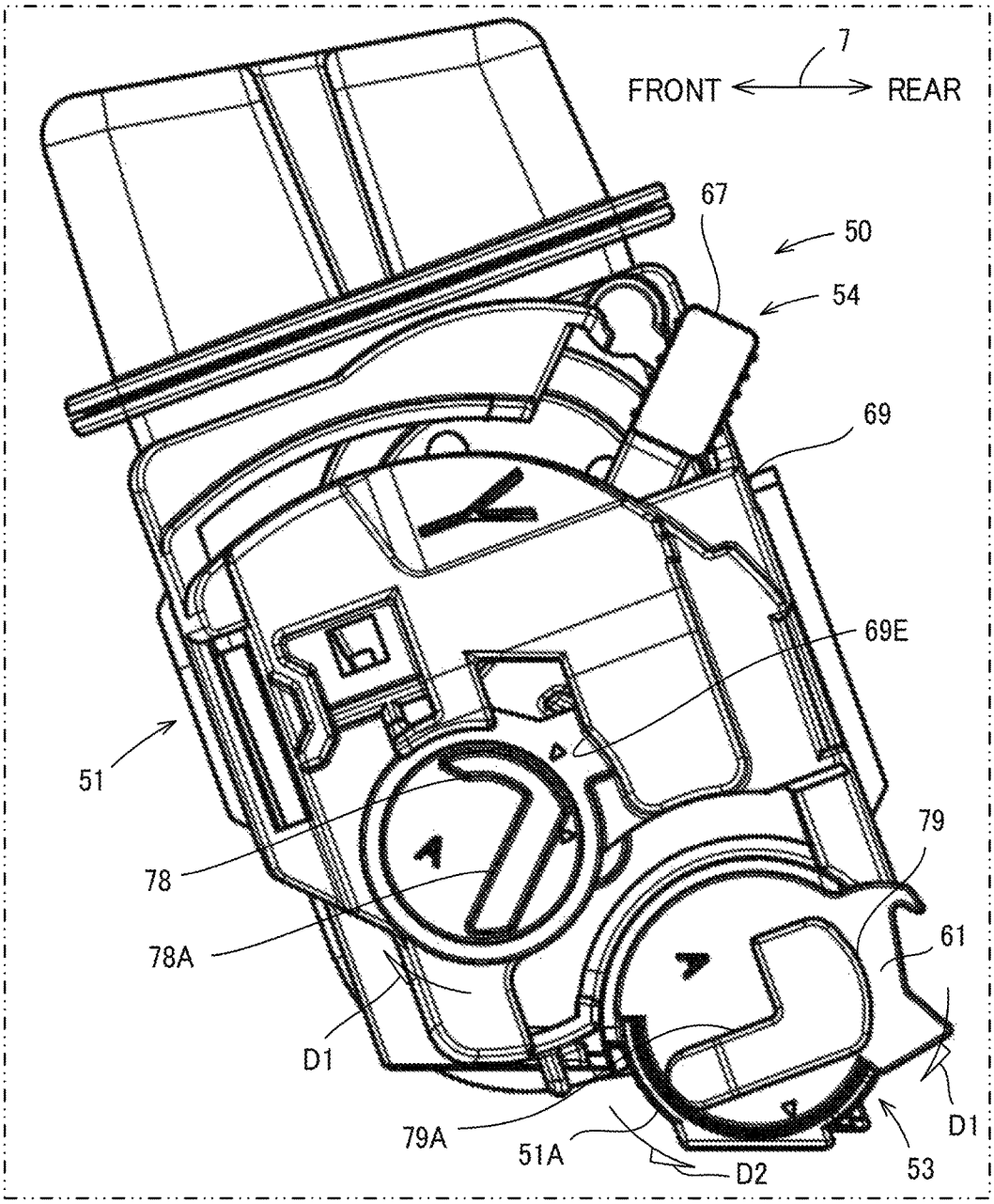

When the first connection portion 78 rotates, by operation of the operation lever 67, to be located at the position shown in FIG. 14B in a state where the toner container 50 is located at the mounting position in the mounting portion 40, the engagement rib 78A intersects the mounting direction of the toner container 50 in a state where the engagement rib 78A is inserted in the first connection groove 74B. Accordingly, the engagement rib 78A and the first connection groove 74B become engaged with each other in the direction in which the toner container 50 is detached. As a result, the toner container 50 is locked at the mounting position in the mounting portion 40. In this manner, the mechanism for locking the toner container 50 at the mounting position in the mounting portion 40 is specifically achieved by the first connection portion 78 and the first connection groove 74B. The first connection portion 78 and the first connection groove 74B are an example of a container locking mechanism of the present disclosure.

As shown in FIG. 19, the first connection portion 78 is connected to the first rotation portion 74 of the drive transmission portion 71. Thus, when the first connection portion 78 rotates in the direction of the arrow D1, the first rotation portion 74 rotates integrally with the first connection portion 78 in the direction of the arrow D1. In the present embodiment, when the operation lever 67 is rotated from the first operation position to the second operation position, the first rotation portion 74 reaches the second position (the position shown in FIG. 20) at which the first rotation portion 74 is in contact with a boss-shaped stopper 116 that is provided on the right side surface 43B. At this time, as shown in FIG. 20, the locking groove 74C of the first rotation portion 74 opposes the hook portion 108A, so that the hook portion 108A becomes insertable into the locking groove 74C. That is, the second position is a position at which the hook portion 108A is insertable into the locking groove 74C.

At the drive transmission portion 71, the first gear portion 74A of the first rotation portion 74 is in mesh with the second gear portion 75A of the second rotation portion 75 via the intermediate rotation portion 76. Thus, the operation driving force is transmitted from the first rotation portion 74 to the second rotation portion 75, and the second rotation portion 75 rotates in the same direction as that of the arrow D1 (in the clockwise direction in FIG. 19).

The second rotation portion 75 is connected to the second connection portion 79 of the shutter member 61. Thus, when the second rotation portion 75 rotates in the direction of the arrow D1, the second connection portion 79 rotates integrally with the second rotation portion 75 in the direction of the arrow D1. Then, by the second connection portion 79 rotating, the shutter member 61 rotates integrally with the second connection portion 79 from the closing position toward the opening position side. Accordingly, the toner discharge port 52 is opened.

When the second connection portion 79 rotates, by operation of the operation lever 67, to be located at the position shown in FIG. 14B, the engagement rib 79A intersects the mounting direction of the toner container 50 in a state where the engagement rib 79A is inserted in the second connection groove 75B. In this case as well, the engagement rib 79A and the second connection groove 75B become engaged with each other in the direction in which the toner container 50 is detached. As a result, the toner container 50 is locked at the mounting position in the mounting portion 40. The second connection portion 79 and the second connection groove 75B in this case are another example of the container locking mechanism of the present disclosure.

As shown in FIG. 19, the rotation portion 108 receives the spring force generated by the coil spring 103, until the first rotation portion 74 reaches the second position. However, since the hook portion 108A is in contact with the outer peripheral surface of the support portion 741 of the first rotation portion 74, the second locking member 102 is located at the lever releasing position (the position shown in FIG. 19) at which the hook portion 108A is retracted frontward from the locking groove 74C. Here, the lever releasing position of the second locking member 102 is a position at which the hook portion 108A is not inserted into the locking groove 74C. In this state, the first rotation portion 74 is rotatable from the first position to the second position, so that the operation lever 67 is not locked and is in an unlocked state.

Meanwhile, as shown in FIG. 20, when the first rotation portion 74 reaches the second position to obtain a state where the locking groove 74C opposes the hook portion 108A, the hook portion 108A is not in contact with the outer peripheral surface of the support portion 741. Thus, as shown in FIG. 21, the second locking member 102 rotates in the direction of the arrow D32 from the lever releasing position, by receiving the spring force generated by the coil spring 103, to shift to the lever locking position (the position shown in FIG. 21) at which the hook portion 108A is inserted into the locking groove 74C. Accordingly, rotation of the first rotation portion 74 is inhibited. That is, when the second locking member 102 is located at the lever locking position, the second locking member 102 locks the first rotation portion 74 at the second position such that the first rotation portion 74 cannot rotate. By the first rotation portion 74 being locked at the second position, the operation lever 67 is also locked at the second operation position. That is, when the hook portion 108A is inserted into the locking groove 74C, the second locking member 102 locks the operation lever 67 at the second operation position. By the operation lever 67 being locked at the second operation position, the shutter member 61 is also locked at the opening position.

Thereafter, when the toner within the toner container 50 is consumed and the remaining amount of the toner decreases to the empty state, the control portion 80 determines that the remaining amount of the toner in the toner container 50 is in the empty state, on the basis of a detection signal sent from the remaining amount sensor 87. In this case, the control portion 80 energizes the solenoid 101 to operate the solenoid 101 to retract the plunger 101A into the solenoid body. Accordingly, as shown in FIG. 22, the second locking member 102 rotates in the direction of the arrow D31 (the clockwise direction in FIG. 22), by receiving force in the direction in which the plunger 101A of the solenoid 101 is retracted, to be located at the lever releasing position. As a result, the operation lever 67 locked at the second operation position is unlocked.

The energization of the solenoid 101 is continued until the toner container 50 is detached from the mounting portion 40. That is, when an operation (releasing operation) of returning the operation lever 67 from the second operation position to the first operation position is performed to unlock the toner container 50 and then the toner container 50 is detached from the mounting portion 40, the control portion 80 stops the energization of the solenoid 101. When the conduction between the contact terminal 95 of the memory holder 90 and the contact terminal of the attachment portion 47 is lost due to the detachment of the toner container 50, the control portion 80 determines that the toner container 50 has been detached from the mounting portion 40.

When the energization of the solenoid 101 is stopped, the plunger 101A is becomes free and the second locking member 102 receives force in the direction of the arrow D32 due to the coil spring 103. However, since the first rotation portion 74 has been returned to the first position shown in FIG. 19, the hook portion 108A of the second locking member 102 is not inserted into the locking groove 74C.

Incidentally, a configuration for locking a plurality of doors cannot be applied to an image forming apparatus in which doors to be opened/closed for individually taking out toner containers are not provided. On the other hand, in the image forming apparatus that does not have a plurality of doors, generally, a relatively large opening is provided in an apparatus body, and a cover for opening/closing the opening is provided. Meanwhile, if the cover is locked, by using the conventional art, until the remaining amount of toner becomes small, the opening cannot be opened in performing maintenance other than replacement of the toner container. On the other hand, if the cover is not covered, the user can directly access the toner container mounted to the container mounting portion, in a state where the cover is opened. In this case, application of a locking mechanism for locking the toner container itself at the mounting position in the container mounting portion in a state where the toner container is mounted, thereby preventing detachment of the toner container, is conceivable. However, in the case where the locking mechanism is configured to be able to be unlocked by the user even in a case other than replacement of the toner container, a problem arises that a gap occurs in a sealing portion of the toner discharge port due to shock or vibration occurring when the toner container is frequently and repeatedly mounted and detached, and the container mounting portion is stained by the toner dropping through the gap. In addition, the toner container in which the toner is stored may be detached and replaced by accident.

In the present embodiment, since the above-described lever locking portion 100 is provided, when the unused toner container 50 is inserted to the mounting position of the mounting portion 40 and is locked to the mounting portion 40 by operation of the operation lever 67, and the shutter member 61 is shifted from the closing position to the opening position, the toner container 50 becomes usable. Until the toner within the toner container 50 is consumed to be in the empty state, the operation lever 67 is locked at the second operation position by the lever locking portion 100. That is, until the toner within the toner container 50 is caused to be in the empty state, the user cannot return the operation lever 67 from the second operation position to the first operation position, and thus cannot move the shutter member 61 from the opening position to the closing position. Therefore, until the toner container 50 enters the empty state, the user cannot close the toner discharge port 52 by operating the operation lever 67, so that detachment of the toner container 50 is limited. As a result, the number of times the toner container 50 is mounted and detached is decreased, and the frequency of the toner dropping from the toner discharge port 52 when the toner container 50 is mounted or detached is reduced, so that the mounting portion 40 can be prevented from being stained by the toner.

[Unlocking Member 120]

A situation in which the toner container 50 should be detached when the operation lever 67 is locked at the second operation position by the lever locking portion 100 may arise. Examples of the situation include the case where poor contact of the contact terminal 95 of the memory holder 90 occurs and the mounted state of the toner container 50 has to be checked. In order to allow the operation lever 67 to be operated from the second operation position to the first operation position in such a situation, an unlocking member 120 with which the operation lever 67 locked by the lever locking portion 100 can be manually unlocked is provided in the image forming apparatus 10 of the present embodiment.

As shown in FIG. 17, the unlocking member 120 is mounted on the right side surface 43B of the support plate 43. The unlocking member 120 is provided between the drive transmission portions 71 and the solenoids 101. The unlocking member 120 is a rod-like member and extends along the right side surface 43B of the support plate 43 in the direction in which the four drive transmission mechanisms 70 are aligned (the front-rear direction 7). The unlocking member 120 is supported on the right side surface 43B so as to be movable in the front-rear direction 7. The unlocking member 120 is formed of, for example, a metallic wire member or a resin member.

An operation portion 121 that is inserted through a later-described opening 125 is formed at the front end of the unlocking member 120. In addition, a hook 122 on which a later-described coil spring 126 is mounted is formed at the rear end of the unlocking member 120.

The operation portion 121 is a portion formed by bending the front end side of the unlocking member 120 at a right angle. The opening 125 is formed at the front end side of the support plate 43 and in a rectangular elongated shape so as to extend in the front-rear direction 7. As shown in FIGS. 6 and 7, the opening 125 is formed at the front side with respect to the container guide 45 that is located at the frontmost side. The operation portion 121 is inserted through the opening 125 and projects outward from the left side surface 43A at the opposite side. In a state where the operation portion 121 does not receive force other than the spring force of the later-described coil spring 126, the operation portion 121 receives the spring force and is hooked on the rear end of the opening 125.

The coil spring 126 is mounted as a biasing member on the right side surface 43B of the support plate 43. The coil spring 126 is a so-called tension spring. The coil spring 126 is hooked at one end (rear end) thereof on a fixing hook 127 provided on the right side surface 43B and is hooked at another end (front end) thereof on the hook 122 of the unlocking member 120. Accordingly, the coil spring 126 provides force that biases the unlocking member 120 rearward. Instead of the coil spring 126, it is possible to use another elastic member such as a helical torsion spring.

The unlocking member 120 receives the rearward spring force generated by the coil spring 126, but further rearward movement of the unlocking member 120 is inhibited by the operation portion 121 being hooked on the rear end of the opening 125 as described above. In a state where the unlocking member 120 does not receive force other than the spring force of the coil spring 126, an initial attitude in which the operation portion 121 is hooked on the rear end of the opening 125 is kept as shown in FIG. 17.

Four engagement pieces 128 are formed in the unlocking member 120 so as to correspond to the respective lever locking portions 100. In the initial attitude, each engagement piece 128 is disposed at the rear side with respect to the rotation portion 108 of the second locking member 102 located at the lever locking position. By the unlocking member 120 being moved frontward from the initial attitude, each engagement piece 128 comes into contact with the rotation portion 108 and presses the rotation portion 108 frontward.

In a mounted state where the toner container 50 is mounted to the mounting portion 40, the unlocking member 120 is moved frontward from the initial attitude by an elongated jig or the like. Specifically, the operation portion 121 is pulled frontward from the left side surface 43A side of the support plate 43. Accordingly, the unlocking member 120 moves frontward from the initial attitude. During this movement, the engagement pieces 128 press frontward all the second locking members 102 each located at the lever locking position. Specifically, the engagement pieces 128 press the rotation portions 108 frontward. Accordingly, each second locking member 102 rotates in the direction of the arrow D31 and moves to the lever releasing position at which the hook portion 108A is retracted from the locking groove 74C, whereby each operation lever 67 locked at the second operation position is unlocked.

In the above embodiment, the configuration in which the shutter member 61 performs opening/closing in conjunction with operation of the operation lever 67 has been described. However, the present disclosure is not limited to such a configuration. For example, it is also possible to adopt a configuration in which the shutter member 61 is not operated in conjunction with operation of the operation lever 67 and opening/closing is performed by another operation lever. In this case, the operation lever 67 is used only for unlocking the toner container 50 locked to the mounting portion 40.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

a toner container having a toner discharge port through which toner within a container body is discharged;

a container mounting portion configured to detachably mount the toner container;

a lever member displaceably provided to the toner container;

a container locking mechanism configured to lock the toner container at a mounting position in the container mounting portion when the lever member is operated from a first operation position to a second operation position in a state where the toner container is located at the mounting position;

a locking member configured to be displaceable between a lever locking position at which the locking member is engaged with the lever member to lock the lever member at the second operation position and a lever releasing position at which the locking member is retracted from the lever locking position to unlock the lever member locked at the second operation position;

a drive portion configured to provide driving force to the locking member;

a remaining amount detection portion configured to detect a remaining amount of the toner within the container body; and a locking control portion configured to control the drive portion to displace the locking member to the lever locking position when the remaining amount of the toner detected by the remaining amount detection portion is equal to or greater than a predetermined amount, and to control the drive portion to displace the locking member to the lever releasing position when the remaining amount of the toner detected by the remaining amount detection portion is less than the predetermined amount, wherein the container mounting portion has a drive transmission mechanism including an input portion configured to receive operating force inputted when the lever member is operated in the state where the toner container is located at the mounting position, and the container locking mechanism includes a first connection portion that is provided to the toner container so as to be rotatable in accordance with displacement of the lever member and that is configured to connect to the input portion when the toner container is located at the mounting position and the lever member is located at the first operation position, and to come into engagement with the input portion in a direction in which the toner container is detached, by rotating in accordance with a locking operation performed when the lever member is operated from the first operation position to the second operation position, to thereby lock the toner container at the mounting position.

2. The image forming apparatus according to claim 1, wherein the first connection portion disengages from the input portion by rotating in accordance with a releasing operation performed when the lever member is returned from the second operation position to the first operation position.

3. The image forming apparatus according to claim 1, wherein the first connection portion is provided so as to be integrated with the lever member and is formed in a rib shape, the input portion is rotatably provided to the container mounting portion and rotates with rotation of the first connection portion, and the container locking mechanism includes a first engagement groove that is formed on the input portion and into which the first connection portion is insertable when the lever member is located at the first operation position.

4. The image forming apparatus according to claim 3, wherein the input portion has a locking groove into which the locking member is insertable when the input portion is located at a position corresponding to the second operation position of the lever member, and the locking member is configured to be inserted into the locking groove when the locking member is displaced to the lever locking position.

5. The image forming apparatus according to claim 1, wherein the drive transmission mechanism includes an output portion configured to output the operating force transmitted from the input portion when the lever member is operated, the toner container has an opening/closing mechanism configured to open/close the toner discharge port, and the opening/closing mechanism has:

a second connection portion capable of connecting to the output portion and receiving the operating force from the output portion when the toner container is located at the mounting position and the lever member is located at the first operation position; and a shutter member configured to shift from a closing position at which the shutter member closes the toner discharge port to an opening position at which the shutter member opens the toner discharge port, by the operating force transmitted from the output portion to the second connection portion in accordance with the locking operation.

6. The image forming apparatus according to claim 5, wherein the second connection portion comes into engagement with the output portion in the direction in which the toner container is detached, by rotating in accordance with the locking operation.

7. The image forming apparatus according to claim 6, wherein the second connection portion disengages from the output portion by rotating in accordance with a releasing operation performed when the lever member is returned from the second operation position to the first operation position.

8. The image forming apparatus according to claim 5, wherein the second connection portion is provided so as to be integrated with the shutter member and is formed in a rib shape, and the output portion has a second engagement groove that is rotatably provided on the container mounting portion and into which the second connection portion is insertable when the shutter member is located at the closing position.

9. The image forming apparatus according to claim 1, wherein the toner container is one of a plurality of toner containers that are provided, the lever member, the container locking mechanism, the locking member, the drive portion, and the remaining amount detection portion are provided so as to correspond to each of the plurality of the toner containers, and the locking control portion controls the drive portion for each of the plurality of the toner containers to displace the locking member to the lever locking position or the lever releasing position.

* * * * *